US007190360B1

(12) United States Patent
Hiroki

(10) Patent No.: US 7,190,360 B1
(45) Date of Patent: Mar. 13, 2007

(54) DISPLAY DEVICE AND METHOD OF DRIVING THE SAME

(75) Inventor: Masaaki Hiroki, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/382,677

(22) Filed: Aug. 25, 1999

(30) Foreign Application Priority Data

Aug. 31, 1998 (JP) ..... 10-246417
Nov. 18, 1998 (JP) ..... 10-327399
Mar. 31, 1999 (JP) ..... 11-091888

(51) Int. Cl.
*G09G 5/00* (2006.01)

(52) U.S. Cl. ..... 345/213; 345/99; 345/103; 345/690

(58) Field of Classification Search ..... 345/3.2, 345/3.3, 3.4, 89, 98–100, 204, 667, 611, 88, 345/694, 690, 698, 699, 213, 76, 82, 92, 345/103, 691, 214; 375/240.01, 219; 348/678; 386/109; 324/121 R
See application file for complete search history.

(56) References Cited

U.S. PATENT DOCUMENTS 4,713,688 A * 12/1987 Guttner ..... 375/240.01
5,025,400 A * 6/1991 Cook et al. ..... 345/611
5,115,189 A * 5/1992 Holcomb ..... 324/121 R
5,334,996 A * 8/1994 Tanigaki et al. ..... 345/694
5,359,342 A * 10/1994 Nakai et al. ..... 345/89
5,420,645 A 5/1995 Traa et al. ..... 348/626
5,448,259 A 9/1995 Hidaka
5,568,163 A * 10/1996 Okumura ..... 345/100

(Continued)

FOREIGN PATENT DOCUMENTS

EP 02-135421 5/1990

(Continued)

OTHER PUBLICATIONS

Hoekstra, "Frequency Modulation of System Clocks for EMI Reduction", Aug. 1997, pp. 101-106, Hewlett-Packard Journal.

(Continued)

*Primary Examiner*—Henry N. Tran
(74) *Attorney, Agent, or Firm*—Eric J. Robinson; Robinson Intellectual Property Law Office, P.C.

(57) ABSTRACT

The present invention is intended to achieve an improvement in the horizontal resolution of an active matrix semiconductor display device. In accordance with the present invention, by supplying a modulated clock signal obtained by frequency modulating a reference clock signal at a constant period to a driving circuit of an active matrix semiconductor display device or to a driving circuit of a passive matrix semiconductor display device, signal information (the presence or absence of an edge, the extent of nearness) relative to the vicinity of the sampling of video signals (image signals) sampled on the basis of this modulated clock signal can be written to the corresponding pixels of the semiconductor display device as shading information. The driving method of the present invention makes use of a phenomenon which apparently makes the resolution of an image display higher owing to the shading information (visual Mach phenomenon and Craik-O'Brien phenomenon).

24 Claims, 29 Drawing Sheets

U.S. PATENT DOCUMENTS

| | | | | | |
|---|---|---|---|---|---|
| 5,594,569 | A | | 1/1997 | Konuma et al. | |
| 5,600,347 | A | * | 2/1997 | Thompson et al. | 345/667 |
| 5,643,826 | A | | 7/1997 | Ohtani et al. | |
| 5,703,621 | A | * | 12/1997 | Martin et al. | 345/690 |
| 5,736,893 | A | | 4/1998 | Puckette et al. | 327/551 |
| 5,737,033 | A | * | 4/1998 | Musuda | 348/678 |
| 5,757,338 | A | * | 5/1998 | Bassetti et al. | 345/3.2 |
| 5,801,672 | A | | 9/1998 | Masuda et al. | |
| 5,818,412 | A | | 10/1998 | Maekawa | |
| 5,818,413 | A | | 10/1998 | Hayashi et al. | |
| 5,818,870 | A | * | 10/1998 | Yaguchi | 375/219 |
| 5,821,913 | A | * | 10/1998 | Mamiya | 345/88 |
| 5,883,609 | A | * | 3/1999 | Asada et al. | 345/100 |
| 5,909,144 | A | | 6/1999 | Puckette et al. | 327/551 |
| 5,923,962 | A | | 7/1999 | Ohtani et al. | |
| 5,940,061 | A | * | 8/1999 | Sato | 345/99 |
| 6,020,872 | A | * | 2/2000 | Mizukata et al. | 345/99 |
| 6,046,735 | A | * | 4/2000 | Bassetti et al. | 345/204 |
| 6,088,014 | A | | 7/2000 | Furuhashi et al. | |
| 6,104,863 | A | * | 8/2000 | Strolle et al. | 386/109 |
| 6,115,020 | A | | 9/2000 | Taguchi et al. | |
| 6,147,668 | A | * | 11/2000 | Eglit | 345/99 |
| 6,271,822 | B1 | * | 8/2001 | Chiang | 345/99 |
| 6,281,873 | B1 | * | 8/2001 | Oakley | 345/127 |
| 6,320,574 | B1 | * | 11/2001 | Eglit | 345/213 |
| 6,657,640 | B2 | * | 3/2003 | Shigeta | 345/690 |

FOREIGN PATENT DOCUMENTS

| | | |
|---|---|---|
| EP | 08-065609 | 3/1996 |
| EP | 09-149344 | 6/1997 |
| EP | 0 786 867 | 7/1997 |
| EP | 10-268842 | 10/1998 |
| JP | 02-135421 | 5/1990 |
| JP | 07-130652 | 5/1995 |
| JP | 07-135318 | 5/1995 |
| JP | 08-065609 | 3/1996 |
| JP | 08-078329 | 3/1996 |
| JP | 09-149344 | 6/1997 |
| JP | 09-289527 | 11/1997 |
| JP | 10-268842 | 10/1998 |

OTHER PUBLICATIONS

Search Report, European Patent Office, Jul. 27, 2000, 4 pages.

W42C31-09, "Spread Spectrum Frequency Generator", Jul. 1998, pp. 1-9, IC Works.

Application Note 201, "EMI Suppression Techniques with Spread Spectrum Clock Gereator (SSCG) ICs", Feb. 1998, pp. 1-2, IC Works.

Related U.S. Appl. No. 09/740,944, filed Dec. 21, 2000; Hiroki Masaaki; "Display Device and Method of Driving the Same".

H. Furue et al., p. -78: *Characteristics and Driving Scheme of Polymer-Stabilized Monostable FLCD Exhibiting Fast Response Time and High Contrast Ratio with Gray-Scale Capability,* SID Digest, SID International Symposium Digest of Technical Papers, 1998, pp. 782-785.

T. Yoshida et al., 33.2: *A Full-Color Thresholdless Antiferroelectric LCD Exhibiting Wide Viewing Angle with Fast Response Time,* SID Digest, SID International Symposium Digest of Technical Papers, vol. 33, No. 2, 1997, pp. 841-844.

S. Inui et al., *Thresholdless Antiferroelectricity in Liquid Crystals and its Application to Displays,* Journal of Materials Chemistry, 1996, pp. 671-673.

Application Note 201, *EMI Suppresion Techniques with Spread Spectrum Clock Generator (SSCG) ICs,* IC Works, Feb., 1998, pp. 1-2.

* cited by examiner

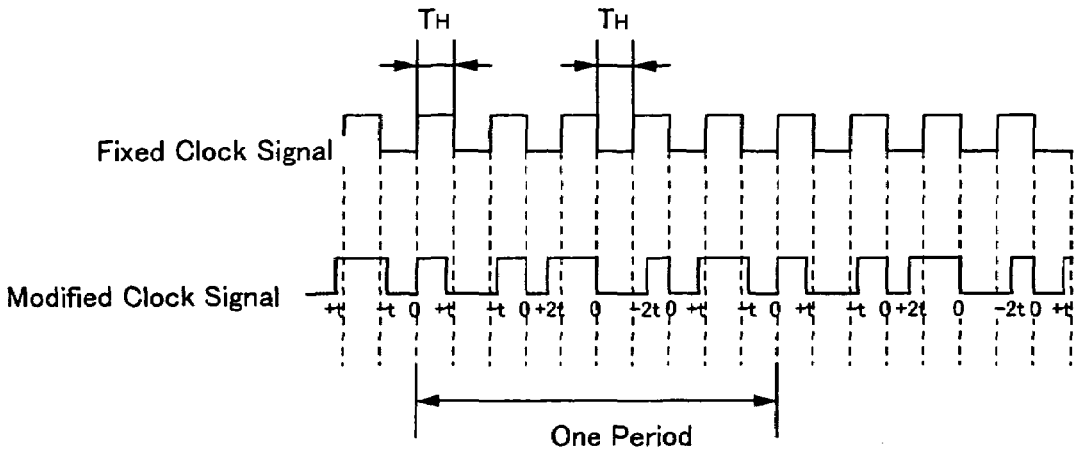
Fig. 4(A)
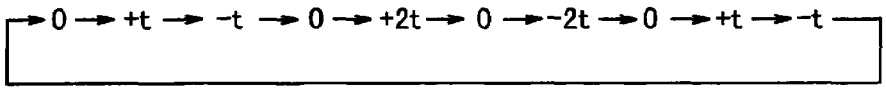
Fig. 4(B)
| displacement | | | | | frequency／10 |
|---|---|---|---|---|---|
| +2t | * | | | | 1 |
| +t | * | * | | | 2 |
| 0 | * | * | * | * | 4 |
| -t | * | * | | | 2 |
| -2t | * | | | | 1 |
Fig. 4(C)

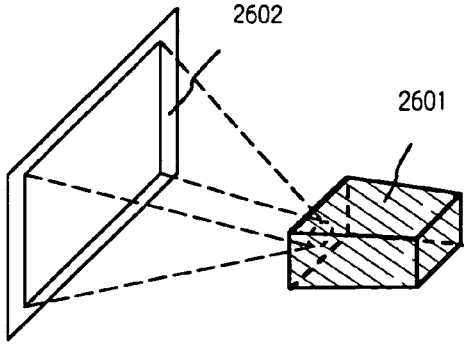
Fig. 18(A)
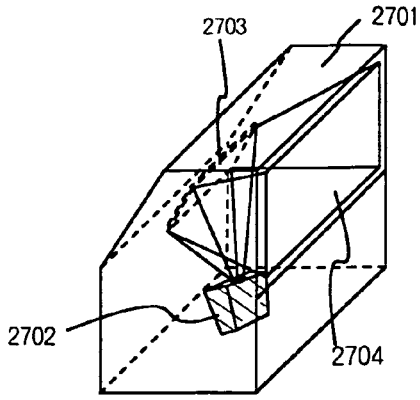
Fig. 18(B)
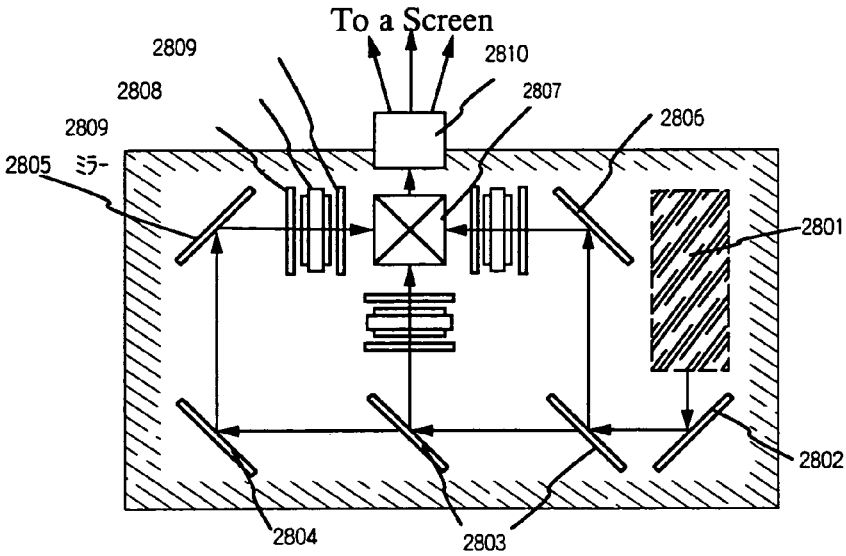
Fig. 18(C) Display Device(3 panel projector)
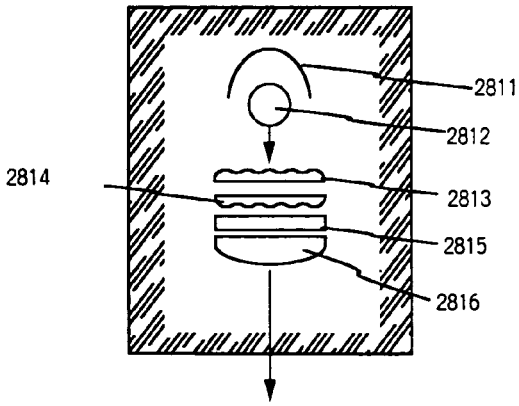
Fig. 18(D) Light Source Optical System 7012
7007
7013
7008
7014
7009
7015
7010
7016
7011
7003
7004
7005
7006
7001
7002
N-type Impurity Addition 7017
7018
7019
7020
7021
7022
7023
P-type Impurity Addition 7024
7025
7026
7027
N-type Impurity Addition 7028
7029
7030
7031
7032
7035
7033
7036
7039
7037
7040
7043
7041
7044
7045
7047
7048
7034
7038
7042
7046

7050
7051
7052
7053
7054
7049
n channel TFT
p channel TFT
n channel TFT
storage capacitor portion
CMOS circuit
Active matrix circuit

DISPLAY DEVICE AND METHOD OF DRIVING THE SAME

BACKGROUND OF THE INVENTION

1. Field of the Invention

The present invention relates to a method of driving a display device and to a display device using the driving method, and more particularly to a method of driving an active matrix semiconductor display device having thin-film transistors (TFTs) fabricated over an insulating substrate. In addition, the present invention relates to an active matrix semiconductor display device using the driving method, and more particularly to an active matrix liquid crystal display device which is one type of active matrix semiconductor display device. The present invention is also applicable to a passive matrix type display device.

2. Description of Related Art

The art of forming semiconductor thin films over an inexpensive glass substrate and fabricating thin-film transistors (TFTs) has recently been making rapid progress. The reason for this is that a demand for active matrix liquid crystal display devices (liquid crystal panels) has been increasing.

In general, in an active matrix liquid crystal display device, pixel TFTs are respectively arranged in at least several tens of pixel areas up to a maximum of several millions of pixel areas which are arranged in a matrix form (this circuit is called active matrix circuit), and electric charges which flow into and out of pixel electrodes located in the respective pixel areas are controlled by the switching function of the pixel TFTs.

The active matrix circuit has conventionally used thin-film transistors which use amorphous silicon formed over a glass substrate.

An active matrix liquid crystal display device which uses thin-film transistors using a polycrystalline silicon film formed over a quartz substrate has recently been realized. In this case, a peripheral driving circuit for driving pixel TFTs can be fabricated on the same substrate as an active matrix circuit.

The art of using a technique such as laser annealing to form a polycrystalline silicon film over a glass substrate and fabricate thin-film transistors is also known. The use of this art makes it possible to integrate an active matrix circuit and a peripheral driving circuit on one glass substrate.

In recent years, active matrix liquid crystal display devices have been widely used as display devices for personal computers. In addition, large-screen active matrix liquid crystal display devices have been becoming used in not only notebook types of personal computers but also desktop types of personal computers.

In addition, attention is becoming drawn to projectors using small-sized active matrix liquid crystal display devices having high definition, high resolution and high image quality. Among such projectors, projectors for high-definition televisions which can display higher-resolution video images are drawing more attention.

CRTs have heretofore been used in the above-described personal computers and projectors. However, if CRTs are used, problems such as power consumption, volume and weight become serious according to the requirements for the sizes and resolutions of screens. For this reason, it has been considered that the aforesaid active matrix liquid crystal display devices replace CRTs which have heretofore been primarily used. However, it has been pointed out that if a conventional active matrix liquid crystal display device and a CRT display images at the same resolution, the conventional active matrix liquid crystal display device is lower in horizontal resolution than the CRT.

FIG. 22 shows a video image of a resolution measuring chart relative to a CRT, while FIG. 23 shows a video image of a resolution measuring chart relative to a rear projector using a conventional active matrix liquid crystal display device. The CRT and the active matrix liquid crystal display device had a resolution of SXGA (1240×1024 pixels). When both video images are compared, it will be seen that the video image, shown in FIG. 23, of the rear projector using the conventional active matrix liquid crystal display device is lower in horizontal resolution than the video image of the CRT which is shown in FIG. 22 (as indicated by an arrow in FIG. 23).

As described above, the conventional active matrix liquid crystal display devices are lower in horizontal resolution than CRTs which conform to the same standards, so that it is difficult for the conventional active matrix liquid crystal display devices to reproduce images with high quality similar to that of CRTs.

Passive matrix liquid crystal display devices are regarded as inferior in image quality to active matrix liquid crystal display devices, but, in various fields, there are demands for passive matrix liquid crystal display devices in that they are simple in structure and inexpensive. However, the current passive matrix liquid crystal display devices have not yet achieved image quality comparable to that of active matrix liquid crystal display devices.

SUMMARY OF THE INVENTION

The present invention has been made in view of the above-described problems, and one object of the present invention is to realize an improvement in the horizontal resolution of an active matrix liquid crystal display device by using a novel driving method. Another object of the present invention is to realize an improvement in the image quality of a passive matrix liquid crystal display device by using a novel driving method.

According to the present invention, by supplying a modulated clock signal obtained by frequency modulating a reference clock signal at a constant period to a driving circuit of an active matrix semiconductor display device or to a driving circuit of a passive matrix semiconductor display device, signal information (the presence or absence of an edge, the extent of nearness) relative to the vicinity of the sampling of video signals (image signals) sampled on the basis of this modulated clock signal can be written to the corresponding pixels of the semiconductor display device as shading information. The driving method of the present invention makes use of a phenomenon which apparently makes the resolution of an image display higher owing to the shading information (visual Mach phenomenon and Craik-O'Brien phenomenon).

Methods of driving semiconductor display devices according to the present invention and the constructions of semiconductor display devices using the driving methods will be described below.

In accordance with a first aspect of the present invention, there is provided a method of driving a semiconductor display device, the method comprising the steps of:

frequency modulating a reference clock signal and obtaining a modulated clock signal;

sampling an image signal on the basis of the modulated clock signal; and supplying the sampled image signal to a corresponding pixel and obtaining an image.

In accordance with a second aspect of the present invention, there is provided a method of driving a semiconductor display device, the method comprising the steps of:

performing sampling and A/D conversion on an analog image signal on the basis of a reference clock signal and obtaining a digital image signal;

after performing digital signal processing on the digital image signal, performing D/A conversion on the digital image signal on the basis of the reference clock signal and obtaining an improved analog image signal; and supplying the improved analog image signal to a corresponding pixel and obtaining an image.

In accordance with a third aspect of the present invention, there is provided a method of driving a semiconductor display device, the method comprising the steps of:

frequency modulating a reference clock signal and obtaining a modulated clock signal;

performing sampling and A/D conversion on an analog image signal on the basis of the modulated clock signal and obtaining a digital image signal;

after performing digital signal processing on the digital image signal, performing D/A conversion on the digital image signal on the basis of a modulated clock signal and obtaining an improved analog image signal; and supplying the improved analog image signal to a corresponding pixel and obtaining an image.

In accordance with a fourth aspect of the present invention, in the method of driving a semiconductor display device, the modulated clock signal may be obtained by shifting a frequency of the reference clock signal on the basis of a Gaussian histogram.

In accordance with a fifth aspect of the present invention, in the method of driving a semiconductor display device, the modulated clock signal may be obtained by randomly shifting a frequency of the reference clock signal.

In accordance with a sixth aspect of the present invention, in the method of driving a semiconductor display device, the modulated clock signal may be obtained by shifting a frequency of the reference clock signal in the form of a sine wave.

In accordance with a seventh aspect of the present invention, in the method of driving a semiconductor display device, the modulated clock signal may be obtained by shifting a frequency of the reference clock signal in the form of a triangular wave.

In accordance with an eighth aspect of the present invention, there is provided a semiconductor display device comprising:

an active matrix circuit having a plurality of thin-film transistors arranged in a matrix form; and a source signal line-side driving circuit and a gate signal line-side driving circuit for driving the active matrix circuit, wherein a modulated clock signal obtained by frequency modulating a reference clock signal is inputted to the source signal line-side driving circuit, while a fixed clock signal is inputted to the gate signal line-side driving circuit.

In accordance with a ninth aspect of the present invention, there is provided a semiconductor display device comprising:

an active matrix circuit having a plurality of thin-film transistors arranged in a matrix form; and a source signal line-side driving circuit and a gate signal line-side driving circuit for driving the active matrix circuit, wherein a modulated clock signal obtained by frequency modulating a reference clock signal is inputted to the source signal line-side driving circuit, while a modulated clock signal which differs from the modulated clock signal in quantity of frequency shifting or method of frequency modulation is inputted to the gate signal line-side driving circuit.

In accordance with a tenth aspect of the present invention, there is provided a semiconductor display device comprising a passive matrix circuit, wherein an image signal sampled on the basis of a modulated clock signal obtained by frequency modulating a reference clock signal is inputted to a signal electrode of the passive matrix circuit, and a fixed clock signal being inputted to a scanning electrode of the passive matrix circuit.

In accordance with an eleventh aspect of the present invention, there is provided a semiconductor display device comprising a passive matrix circuit, wherein an image signal sampled on the basis of a modulated clock signal obtained by frequency modulating a reference clock signal is inputted to a signal electrode of the passive matrix circuit, and a modulated clock signal which differs from the modulated clock signal in quantity of frequency shifting or method of frequency modulation is inputted to a scanning electrode of the passive matrix circuit.

In accordance with a twelfth aspect of the present invention, in the semiconductor display device, the modulated clock signal may be obtained by shifting a frequency of the reference clock signal on the basis of a Gaussian histogram.

In accordance with a thirteenth aspect of the present invention, in the semiconductor display device, the modulated clock signal may be obtained by randomly shifting a frequency of the reference clock signal.

In accordance with a fourteenth aspect of the present invention, in the semiconductor display device, the modulated clock signal may be obtained by shifting a frequency of the reference clock signal in the form of a sine wave.

In accordance with a fifteenth aspect of the present invention, in the semiconductor display device, the modulated clock signal may be obtained by shifting a frequency of the reference clock signal in the form of a triangular wave.

The above and other objects, features and advantages of the present invention will become apparent from the following detailed description of preferred embodiments of the present invention, taken in conjunction with the accompanying drawings.

BRIEF DESCRIPTION OF THE DRAWINGS

FIGS. 4(A), 4(B) and 4(C) are views illustrating the modulated clock signal;

FIGS. 16(A) to 16(E), 17(A) to 17(D) and 18(A) to 18(D) are views showing different examples of semiconductor devices in which active matrix liquid crystal display devices using the driving method according to the present invention are incorporated;

DESCRIPTION OF THE PREFERRED EMBODIMENTS

Figure 1:
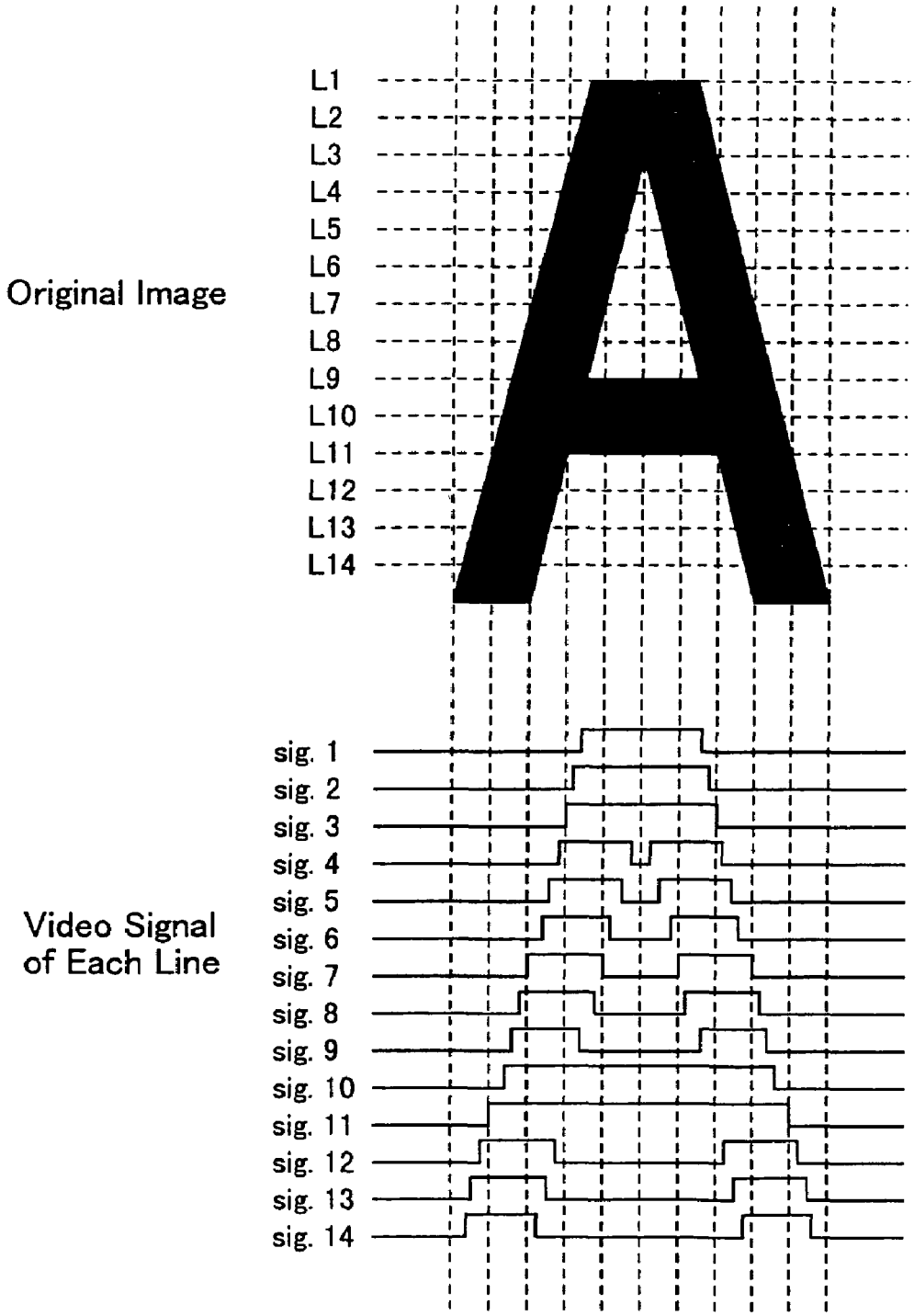
FIG. 1 is a view showing waveforms of video signals based on an original image.

The driving method according to the present invention will be described below in due order. First, reference will be made to FIG. 1. FIG. 1 shows the manner of converting an original image into video signals, for the purpose of illustrating the present invention. The original image "A" is converted into video signals on lines L1 to L14. In FIG. 1, it is assumed that the original image "A" is displayed in black against a white background and has no shading and uniform brightness. The respective video signals of the original image which correspond to the lines L1 to L14 are denoted by sig. 1 to sig. 14.

Figure 2:
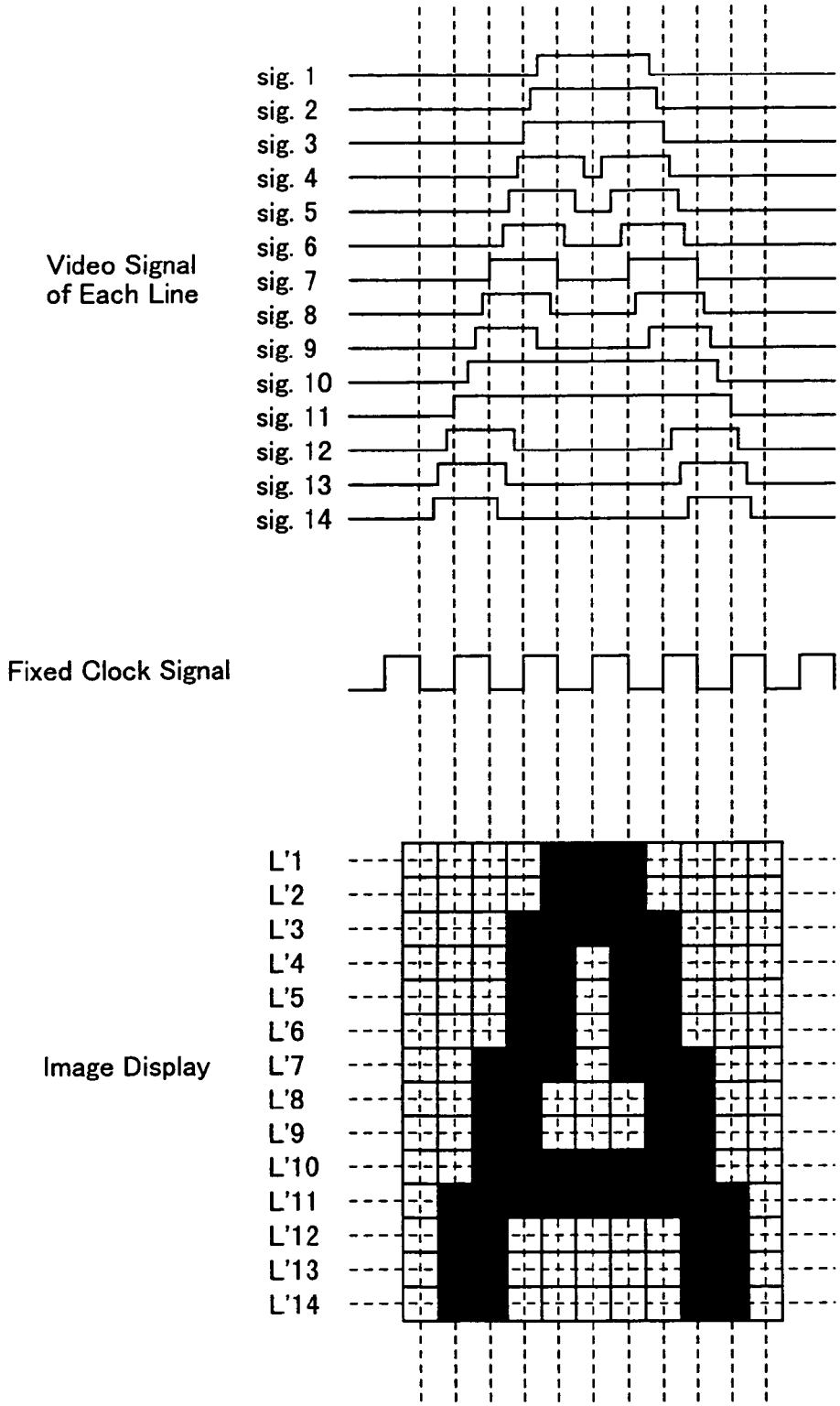
FIG. 2 is a view showing an example of screen display which is provided on an active matrix semiconductor display device when the video signals are sampled by a driving method using a reference clock signal.

Then, reference will be made to FIG. 2. FIG. 2 shows the manner in which the video signals sig. 1 to sig. 14 on the respective lines, which are based on the original image "A", are sampled by a conventional reference clock signal and displayed on the screen of an active matrix semiconductor display device. In FIG. 2, it is assumed that individual pixels of the active matrix semiconductor display device are represented by squares which are shown to be respectively centered at the intersections of dashed lines drawn from the video signals sig. 1 to sig. 14 and dashed lines which respectively represent lines L'1 to L'14 which form a screen image.

The video signals on the respective lines are sampled by a reference clock signal. In this driving method, the video signals are sampled at the rise time and the fall time of each pulse of the reference clock signal. Image information is written to pixels of the semiconductor display device by the sampled video signals so that a video image is displayed on the entire screen. In the screen image, pixels which are displayed in black are the pixels to which the image information is written. In this manner, in the active matrix semiconductor display device, an image is obtained as a set of the image information written to the pixels. In general, the display of an image on the active matrix semiconductor display device is realized by performing writing of such image information by thirty to sixty times per second.

A modulated clock signal which is used in the driving method according to the present invention will be described below. The reference clock signal operates at a constant frequency, whereas the modulated clock signal is a clock signal which shifts in frequency at a certain constant period, i.e., a signal which is frequency-modulated. Incidentally, the modulated clock signal is described in detail in the document "Frequency Modulation of System Clocks for EMI Reduction" (Hewlett-Packard Journal, August 1997, Pages 101 to 106). However, this document only describes the art of reducing EMI (electromagnetic interference) of clock signals by using a modulated clock signal in the field of integrated circuits.

Incidentally, the driving method according to the present invention can also use any type of modulated clock signal obtainable by frequency modulation of a reference clock signal which serves as a reference. Accordingly, the driving method according to the present invention can also use a modulated clock signal due to any method other than the method of the above-cited document and the like.

The driving method according to the present invention will be described below in terms of a modulated clock signal frequency modulated at a certain constant frequency. First, reference will be made to FIGS. 4(A), 4(B) and 4(C). FIG. 4(A) shows a reference clock signal and a modulated clock signal frequency modulated at a certain constant frequency. In the following, a variation in frequency of the modulated clock signal will be described as a displacement of the rise or fall time of a pulse on the time axis of the modulated clock signal. It is assumed that a hold time interval $T_H$ of a pulse of the reference clock signal (the time interval from the rise time of a pulse until the fall time of the pulse or the time interval from the fall time of a pulse until the rise time of the pulse) is divided into five equal time intervals and each of the five equal time intervals of the hold time interval $T_H$ is denoted by t ($T_H$=5t). The following consideration will be given to temporal displacements of the rise times and the fall times of pulses of the modulated clock signal with respect to pulses of the reference clock signal. In the example given herein, as shown in FIG. 4(B), the temporal displacements of the rise times or the fall times of the pulses of the modulated clock signal appear in the form of 0→+t→−t→0→+2t→0→−2t→0+t →−t→0→+t→ . . . with respect to the rise times or the fall times of the pulses of the reference clock signal. In FIG. 4(B), "+t" represents a displacement which advances by the time t, "0" represents the absence of a displacement, and "−t" represents a displacement which delays by the time t. These temporal displacements are based on the Gaussian histogram shown in FIG. 4(C). In this manner, the above-described modulated clock signal is obtained by displacing the rise times and the fall times of the pulses of the reference clock signal by the time intervals ±2t or ±t. One period of the modulated clock signal is five pulses.

If the frequency of the reference clock signal is 100%, the modulated clock signal is subjected to a frequency shift of about +67% to about −29%.

Figure 3:
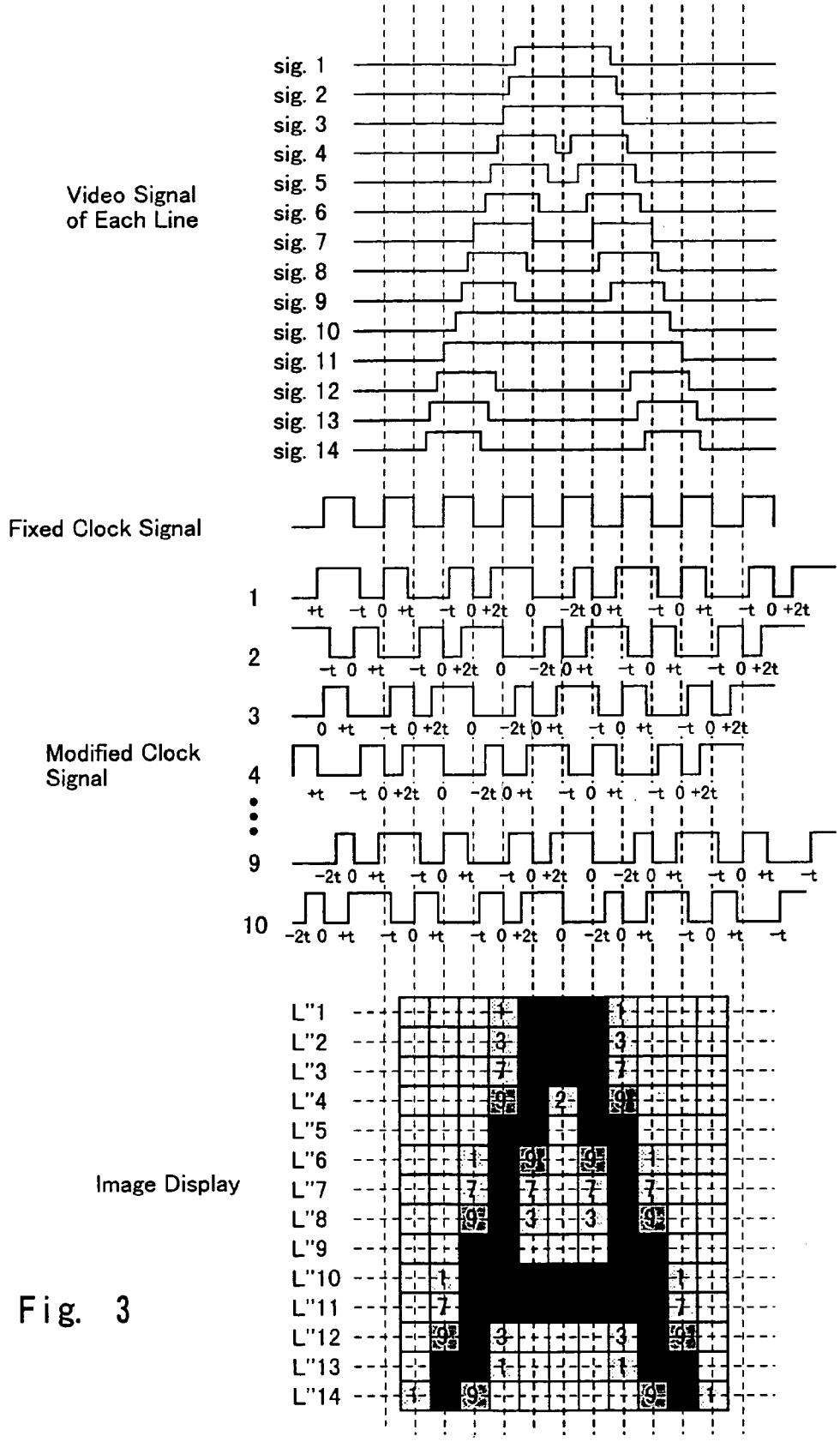
FIG. 3 is a view showing an example of screen display which is provided on the active matrix semiconductor display device when the video signals are sampled by a driving method using a modulated clock signal according to the present invention.
Figure 25:
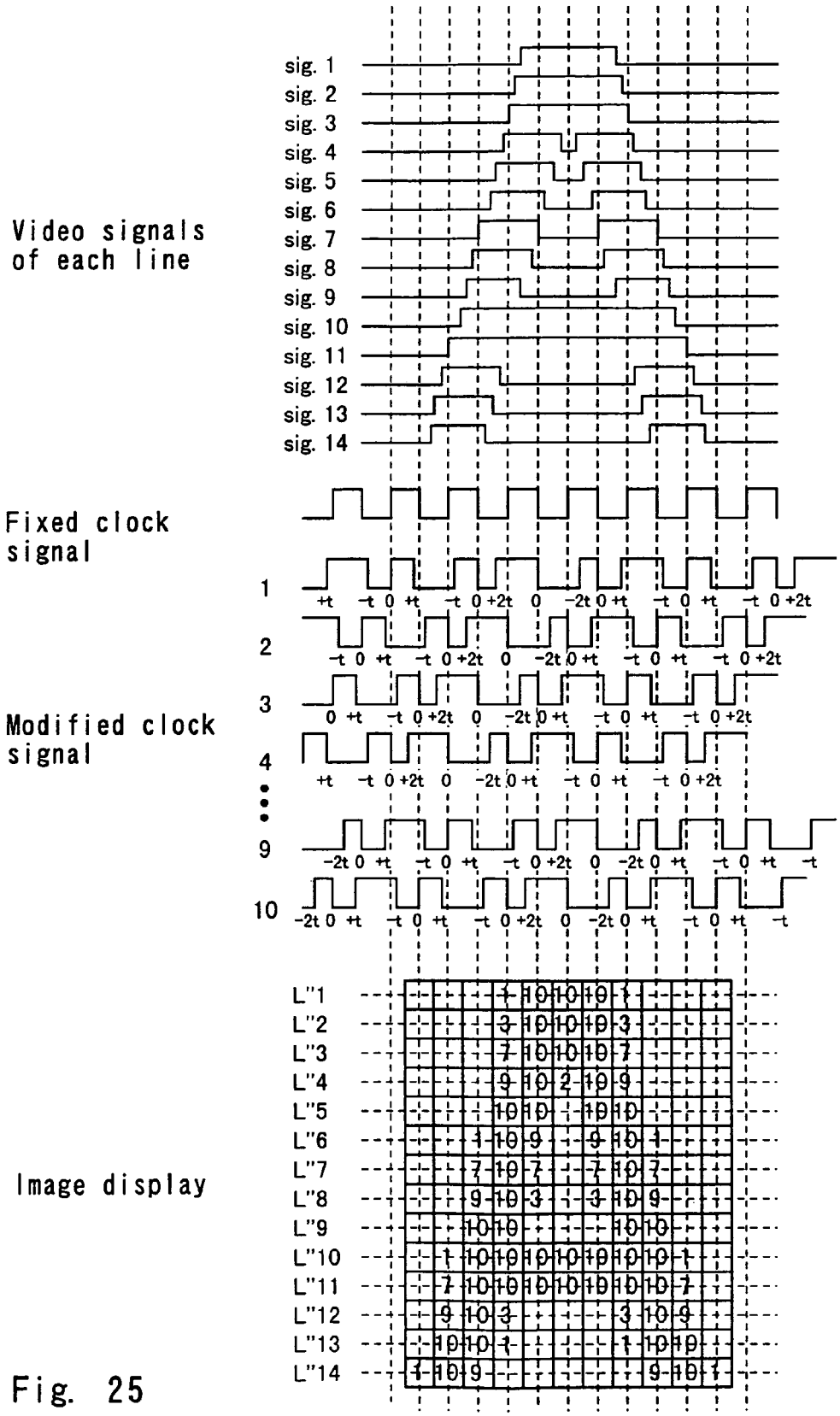
FIG. 25 is a view showing an example of screen display which is provided on an active matrix semiconductor display device when video signals are sampled by a driving method using a modulated clock signal according to the present invention.

Then, reference will be made to FIG. 3 and FIG. 25. FIGS. 3 and 25 show the sampling of video signals on the respective lines by modulated clock signals in the driving method according to the present invention, as well as an image displayed on the screen via lines L"1 to L"14. As shown in FIG. 3, the modulated clock signal described above with reference to FIG. 4 is used, and the video signals on the respective lines use the above-described ones shown in FIG. 1. For reference, a reference clock signal is also shown in FIG. 3. Incidentally, FIGS. 3 and 25 are similar views, but in FIG. 25 the shading of the image displayed on the screen by particular pixels is omitted for convenience of explanation.

The video signals sig. 1 to sig. 14 on the respective lines are sampled at the rise times and the fall times of pulses of the modulated clock signal, and the sampled signals are written to the corresponding pixels as image information.

First, during the first frame, the video signals sig. 1 to sig. 14 on the respective lines are sampled at the pulse timing of a modulated clock signal 1, and the obtained image information is written to the corresponding pixels. Then, during the second frame, the video signals sig. 1 to sig. 14 on the respective lines are sampled at the pulse timing of a modulated clock signal 2, and the obtained image information is written to the corresponding pixels. The modulated clock signal 1 and the modulated clock signal 2 are shifted by a 1/10 period. Furthermore, during the third frame, the video signals sig. 1 to sig. 14 on the respective lines are sampled at the pulse timing of a modulated clock signal 3, and the obtained image information is written to the corresponding pixels. The modulated clock signal 2 and the modulated clock signal 3 are shifted by a 1/10 period. In this manner, the sampling of the video signals for the first to tenth frames and the writing of image information to the corresponding pixels are performed in order.

An image displayed on the screen when the image information for ten frames is written is shown in a lower portion of FIG. 3 as a display provided on lines L"1 to L"14. Incidentally, particular ones of the pixels shown in FIGS. 3 and 25 are marked with numbers 1, 2, 3, 7,9 and 10. These numbers indicate how many times image information was written to the corresponding pixels during the writing of image information for ten frames (for example, 1 means once, 7 means seven times, and 10 means ten times). As is understood from this image display example, as compared with a conventional driving method using a reference clock signal, in the driving method using a modulated clock signal according to the present invention, the ten frames include frames during which no image information is written to pixels corresponding to an outline portion of the image. This result is represented as shading information by the pixels.

An image having shading information in its outline portion in the above-described manner can be viewed by an observer as an image displayed with enhanced resolution, owing to the previously-described visual Mach phenomenon and Craik-O'Brien phenomenon.

It is to be noted that the period of frequency modulation and the amount of frequency shifting of the modulated clock signal can be arbitrarily set. For example, it is possible to use a modulated clock signal whose amount of frequency shifting varies like a sine or triangular wave with respect to the time axis or a modulated clock signal whose amount of frequency shifting varies completely randomly with respect to the time axis.

EMBODIMENTS

The driving method according to the present invention and specific examples of a semiconductor device using the driving method will be described below with reference to preferred embodiments of the present invention. However, the present invention is not limited to only embodiments which will be described below.

Embodiment 1

In the description of the present embodiment, reference will be made to an active matrix liquid crystal display device as one example of a semiconductor display device for which a driving method of a semiconductor display device according to the present invention can be used.

Figure 5:
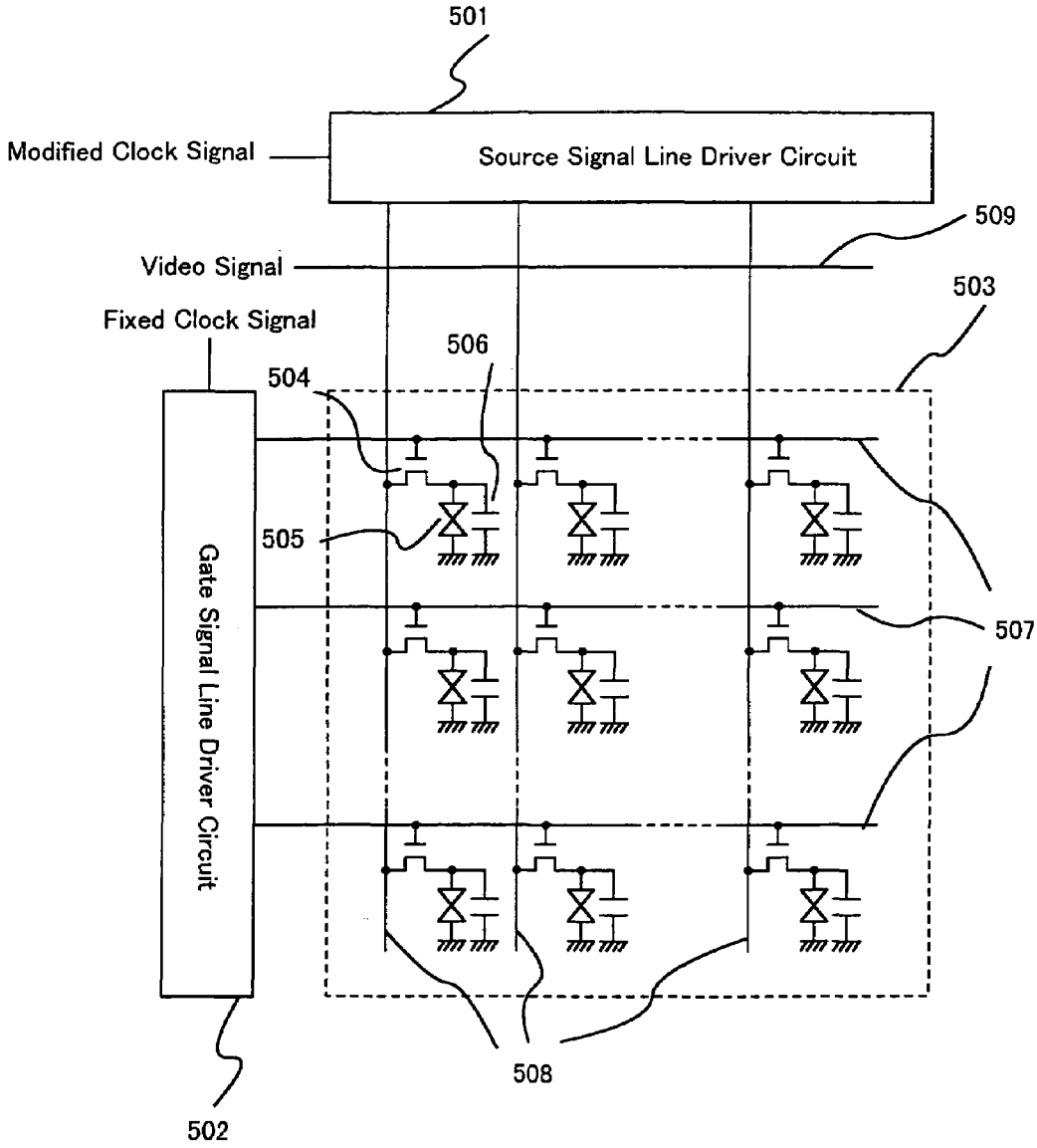
FIG. 5 is a schematic block diagram of an active matrix liquid crystal display device according to Embodiment 1.

Reference will be made to FIG. 5. FIG. 5 shows a schematic block diagram of the active matrix liquid crystal display device of the present embodiment. Reference numeral 501 denotes a source signal line-side driving circuit to which a modulated clock signal, a start pulse and the like are to be inputted. Reference numeral 502 denotes a gate signal line-side driving circuit to which a fixed clock, a start pulse and the like are to be inputted. The term "fixed clock" used here in means a clock signal which operates at a constant frequency on the basis of a reference clock signal. Reference numeral 503 denotes an active matrix circuit which has pixels arranged in a matrix form so that one pixel is disposed at each of the intersections of gate signal lines 507 and source signal lines 508. Each of the pixels has a thin-film transistor 504, and a pixel electrode (not shown) and an auxiliary capacitor 506 are connected to the drain electrode of the thin-film transistor 504. Reference numeral 505 denotes a liquid crystal sandwiched between the active matrix circuit 503 and a counter substrate (not shown). Reference numeral 509 denotes a video signal line to which a video signal is to be externally inputted. Incidentally, the active matrix liquid crystal display device of the present embodiment has pixels of 1,280 in width×1,024 in height and is capable of coping with high-definition television standards.

Figure 6:
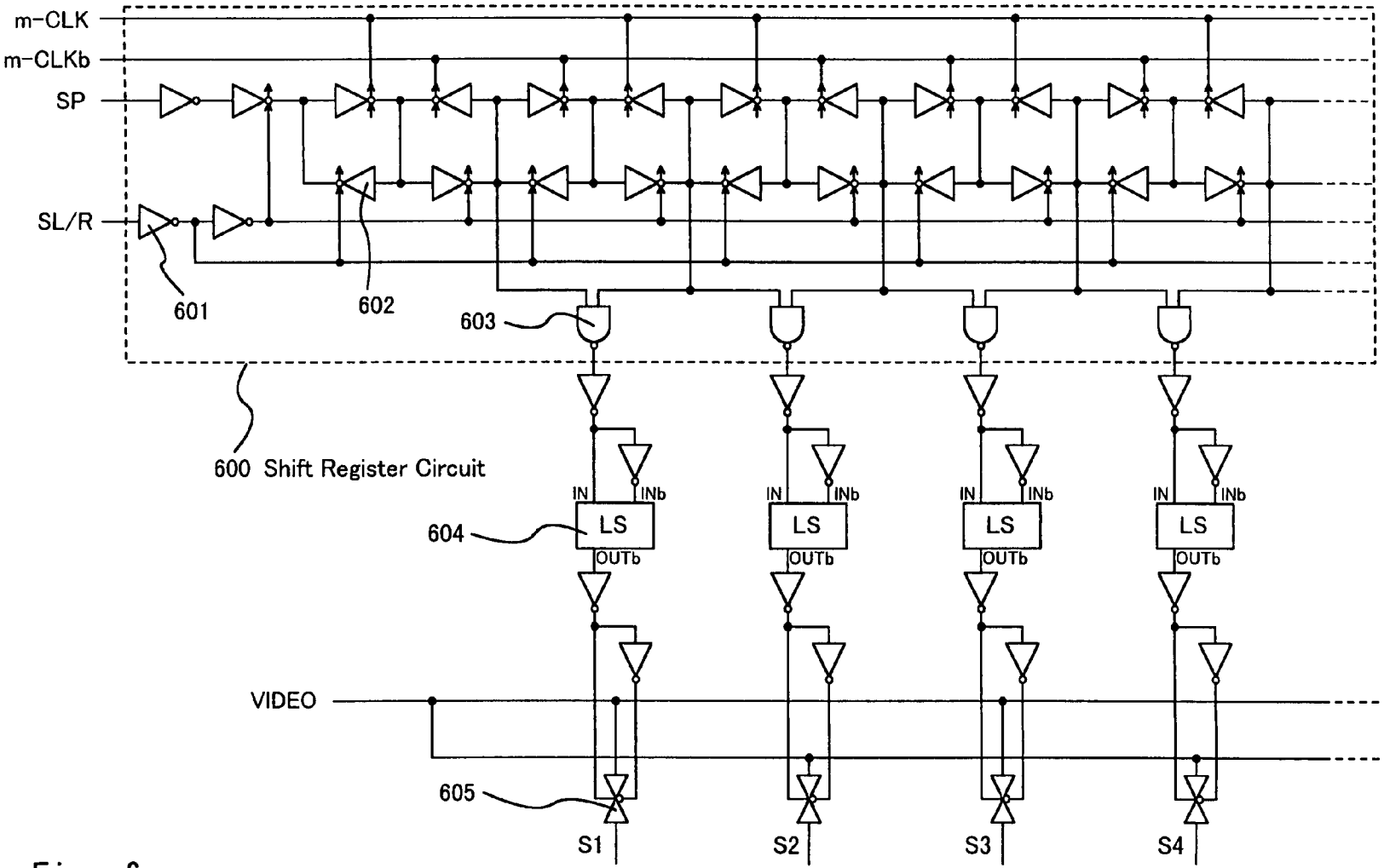
FIG. 6 is a circuit block diagram of a source signal line-side driving circuit of the active matrix liquid crystal display device according to Embodiment 1.
Figure 7:
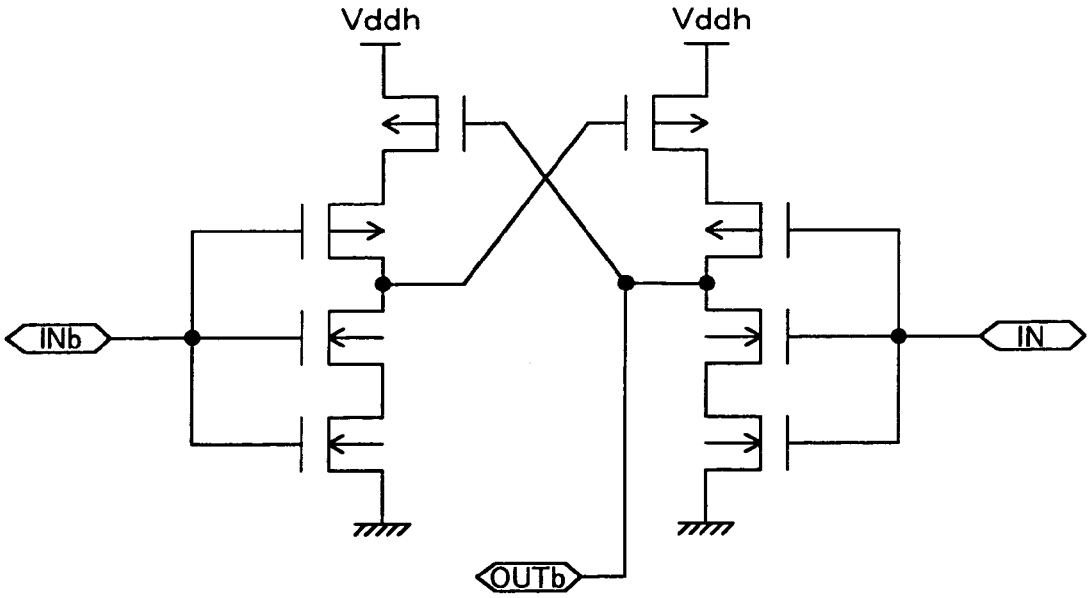
FIG. 7 is a circuit diagram of a level shifter to be used in each of the source signal line-side driving circuit and a gate signal line-side driving circuit of the active matrix liquid crystal display device according to Embodiment 1.

Then, reference will be made to FIG. 6. FIG. 6 shows a circuit block diagram of the source signal line-side driving circuit 501 of the active matrix liquid crystal display device of the present embodiment. Reference numeral 600 denotes a shift register circuit. The shift register circuit 600 has inverters 601, clocked inverters 602, NAND circuits 603 and the like. FIG. 6 shows that only one clock signal is inputted for operating the clocked inverters 602, but in an actual circuit construction, an inverted signal of the clock signal is also inputted. Reference numeral 604 denotes level shifter circuits and reference numeral 605 denotes analog switch circuits, and the circuit construction of each of the level shifter circuits 604 is shown in FIG. 7.

Inputted to the source signal line-side driving circuit 501 are a modulated clock signal (m-CLK), an inverted signal (m-CLKb) of the modulated clock signal, a start pulse (SP) and a leftward/rightward scan switching signal (SL/R).

When the shift register circuit 600 operates in response to the modulated clock signal (m-CLK), the inverted signal (m-CLKb) of the modulated clock signal, the start pulse (SP) and the leftward/rightward scan switching signal (SL/R) all of which are externally inputted, and the leftward/rightward scan switching signal (SL/R) goes to its high level, signals for sampling video signals are outputted from the NAND circuits 603 in the order of from left to right. The source signal line-side driving circuit 501 of the present embodiment outputs in order signals for sampling video signals at the rise times and the fall times of the modulated clock pulse, as described previously in connection with the embodiment of the present invention. The voltage levels of the signals for sampling the video signals are respectively shifted to their higher voltages by the level shifter circuits 604 and are inputted to analog switches 605. The respective analog switches 605 sample the video signals supplied from the video signal lines in response to the input of the sampling signals, and supply the sampled signals to source signal lines (S1 to S4 to S1280 (not shown)). The video signals supplied to the source signal lines are supplied to the thin-film transistors of the corresponding pixels.

Incidentally, W42C31-09 or the like made by IC WORKS, Inc. is available as a module for producing a modulated clock signal.

Figure 8:
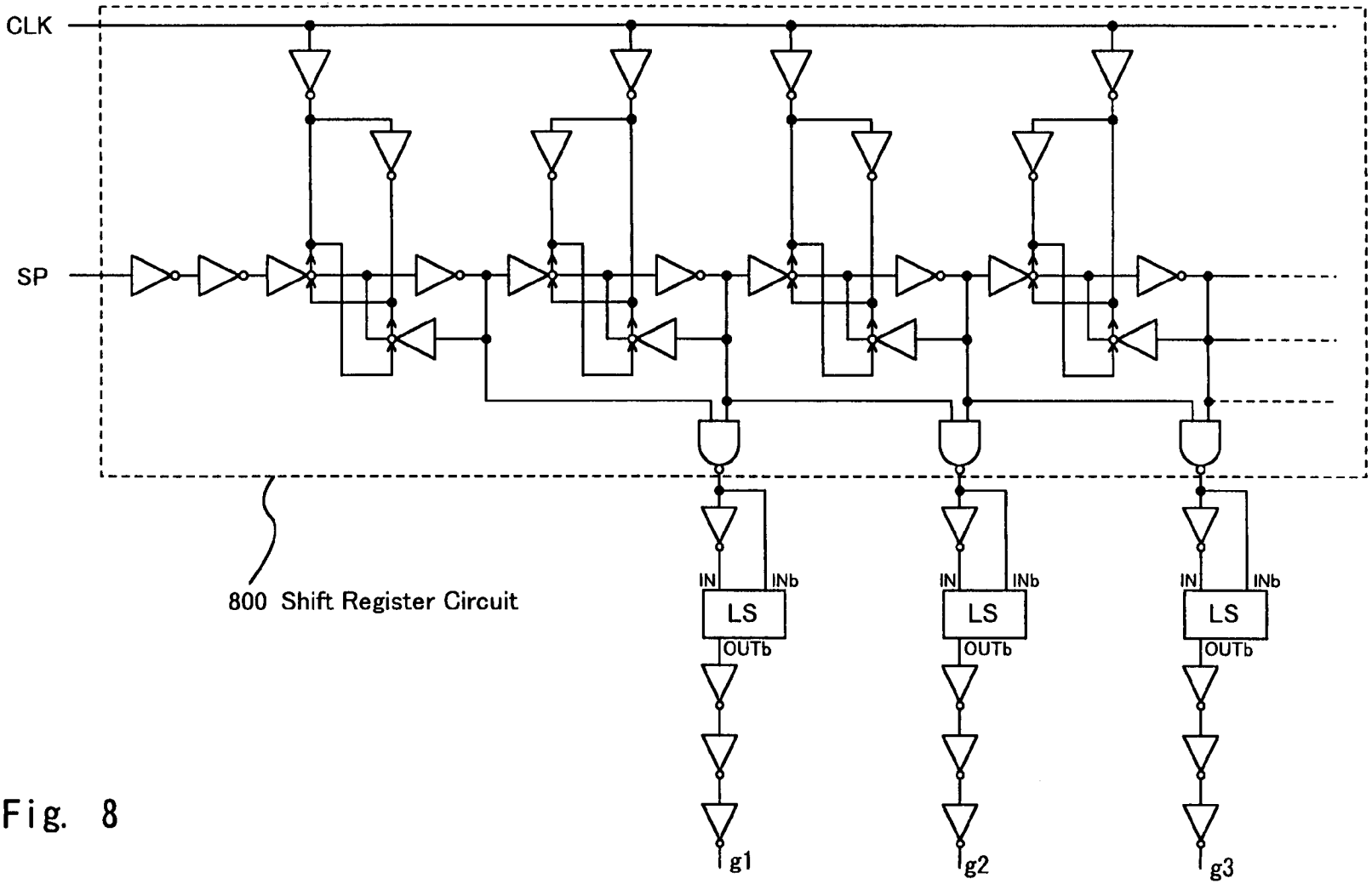
FIG. 8 is a circuit diagram of the gate signal line-side driving circuit of the active matrix liquid crystal display device according to Embodiment 1.

The circuit construction of the gate signal line-side driving circuit 502 of the active matrix liquid crystal display device of the present embodiment will be described below. Referring to FIG. 8, reference numeral 800 denotes a shift register circuit. The shift register circuit 800 has inverter circuits, clocked inverter circuits, NAND circuits and the like. The circuit construction of each level shifter circuit is similar to that shown in FIG. 7.

When the shift register circuit 800 operates in response to a clock signal (CLK) and the start pulse (SP) both of which are externally inputted, signals for making selection from the gate signal lines 507 are outputted from the NAND circuits in the order of from left to right.

A method of fabricating the active matrix liquid crystal display device described above in the description of the present embodiment will be described below. FIGS. 9(A) to 12(C) show an example in which a plurality of TFTs are formed over a substrate having an insulating surface to monolithically constitute a pixel matrix circuit, driving circuits, logic circuits and the like in the present embodiment. Incidentally, FIGS. 9(A) to 12(C) show the process of forming at the same time one pixel of the pixel matrix circuit and a CMOS circuit which is the basic circuit of another circuit (a driving circuit, a logic circuit or the like) in the present embodiment. In addition, the following description will refer to the process of fabricating a CMOS circuit having a P-channel TFT and an N-channel TFT each of which has one gate electrode, but in accordance with the present embodiment, it is similarly possible to fabricate a CMOS circuit using a TFT provided with a plurality of gate electrodes like a double or triple gate type of TFT. In the present embodiment, double-gate N-channel TFTs are used as pixel TFTs, but single- or triple-gate TFTs or the like can also be used.

Figure 9A:
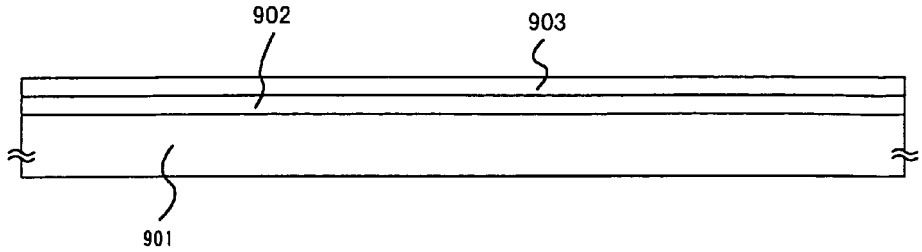
FIGS. 9(A) to 9(E) are views showing an example of the process of fabricating the active matrix liquid crystal display device according to Embodiment 1
Figure 9B:
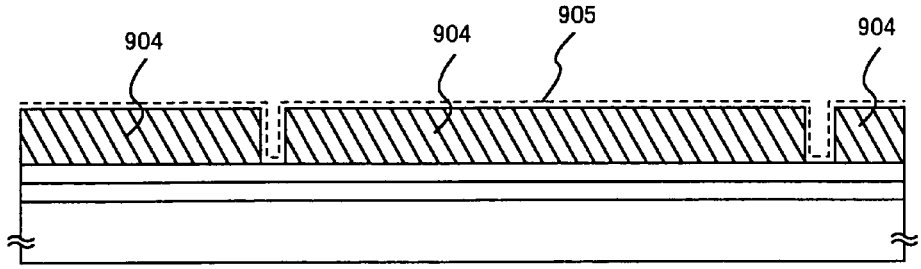
Figure 9C:
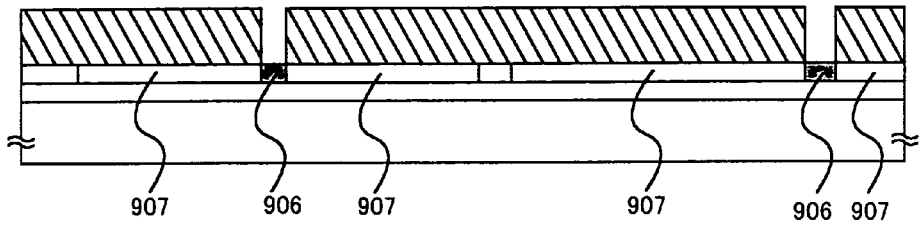

Referring to FIG. 9(A), first, a quartz substrate 901 is prepared as a substrate having an insulating surface. A silicon substrate on which a thermal oxidation film is formed can also be used in place of the quartz substrate 901. Otherwise, it is also possible to adopt a method of temporarily forming an amorphous silicon film on a quartz substrate and completely thermally oxidizing the amorphous silicon film to form it into an insulating film. Otherwise, it is also possible to use a quartz substrate, a ceramic substrate or a silicon substrate on which a silicon nitride film is formed as an insulating film. Then, a base film 902 is formed. In the present embodiment, silicon oxide (SiO2) is used as the base film 902. Then, an amorphous silicon film 903 is formed. The amorphous silicon film 903 is adjusted so that its final film thickness (a film thickness which allows for a reduction in film thickness after thermal oxidation) becomes 10–75 nm (preferably, 15–45 nm).

It is to be noted that it is important to thoroughly control the concentration of impurities in the amorphous silicon film 903 during the formation thereof. In the case of the present embodiment, in the amorphous silicon film 903, each of the concentrations of C (carbon) and N (nitrogen) which are impurities to impede later crystallization is controlled to become less than $5\times10^{18}$ atoms/cm$^3$ (representatively, not greater than $5\times10^{17}$ atoms/cm$^3$, preferably, not greater than $2\times10^{17}$ atoms/cm$^3$), and the concentration of O (oxygen) is controlled to become less than $1.5\times10^{19}$ atoms/cm$^3$ (representatively, not greater than $1\times10^{18}$ atoms/cm3, preferably, not greater than $5\times10^{17}$ atoms/cm$^3$). This is because if the respective impurities are present at concentrations not less than these concentrations, the impurities adversely affect later crystallization and lower the quality of the film after crystallization. In the present specification, the concentrations of the above-noted impurity elements in the film are defined as minimum values in the result of measurement by SIMS (secondary ion mass spectroscopy).

To obtain the above-described construction, it is preferable to periodically dry-clean a reduced-pressure thermal CVD reactor used in the present embodiment and make a film forming chamber clean. In the dry cleaning of the reactor, 100–300 sccm of $ClF_3$ (chlorine fluoride) gas is made to flow in the reactor heated to approximately 200–400° C., and cleaning of the film forming chamber may be performed by using fluorine generated by thermal decomposition.

According to the knowledge of the present applicant, if the inside temperature of the reactor is set to 300° C. and the flow rate of $ClF_3$ gas is set to 300 sccm, deposited foreign matter (which essentially consists of silicon) of thickness about 2 μm can be completely removed in four hours.

The concentration of hydrogen in the amorphous silicon film 903 is also a very important parameter, and it appears that as the hydrogen content is made smaller, the crystallinity of the amorphous silicon film 903 becomes better. For this reason, it is preferable that a reduced-pressure thermal CVD method be used to form the amorphous silicon film 903. Incidentally, if the formation conditions for the amorphous silicon film 903 are optimized, it is also possible to use a plasma CVD method.

Then, the step of crystallizing the amorphous silicon film 903 is performed. The art described in Japanese Patent Laid-Open No. 130652/1995 is used as crystallization means. Although either of Embodiment 1 and Embodiment 2 disclosed in Japanese Patent Laid-Open No. 130652/1995 may be used, it is preferable that the present embodiment make use of the art contents described in Embodiment 2 (which are described in detail in Japanese Patent Laid-Open No. 78329/1996).

According to the art of Japanese Patent Laid-Open No. 78329/1996, first, a mask insulating film 904 for selecting regions in which to add a catalytic element is formed to have a thickness of 150 nm. The mask insulating film 904 has a plurality of apertures through which to add the catalytic element. The location of crystalline regions can be determined by the locations of the apertures (FIG. 9(B)).

Then, a solution 905 which contains nickel (Ni) (an Ni acetate ethanol solution) is applied as a catalytic element which promotes the crystallization of the amorphous silicon film 903, by a spin coating method. Incidentally, it is also possible to use a catalytic element other than nickel, such as cobalt (Co), iron (Fe), palladium (Pd), germanium (Ge), platinum (Pt), copper (Cu) and gold (Au).

The above-described catalytic-element adding step can also use an ion implantation method using a resist mask or a plasma doping method. Either of the methods is an art effective in forming a scaled circuit, because it is easy to realize a decrease in the area occupied by regions in which the catalytic element is added as well as control of a growth distance of a horizontal growth region to be described later.

When the catalytic-element adding step is completed, discharge of hydrogen is continued at 450° C. for approximately 1 hour. After that, the crystallization of the amorphous silicon film 903 is performed by heat treatment of 4–24 hours at a temperature of 500–960° C. (representatively, 550–650° C.) in an inert atmosphere, a hydrogen atmosphere or an oxygen atmosphere. In the present embodiment, heat treatment of 570° C. for 14 hours is performed in a nitrogen atmosphere.

At this time, the crystallization of the amorphous silicon film 903 preferentially proceeds from nuclei which have occurred in regions 906 in which nickel has been added, whereby crystalline regions 907 made from a polycrystalline silicon film which have grown approximately in parallel with the substrate surface of the substrate 901 are formed. These crystalline regions 907 are called horizontal growth regions. The horizontal growth regions have the advantage of total superior crystallinity because individual crystals gather in a comparatively orderly state.

Incidentally, it is also possible to crystallize the amorphous silicon film 903 by applying a Ni acetate ethanol solution to the entire surface of the same without using the mask insulating film 904.

Figure 9D:
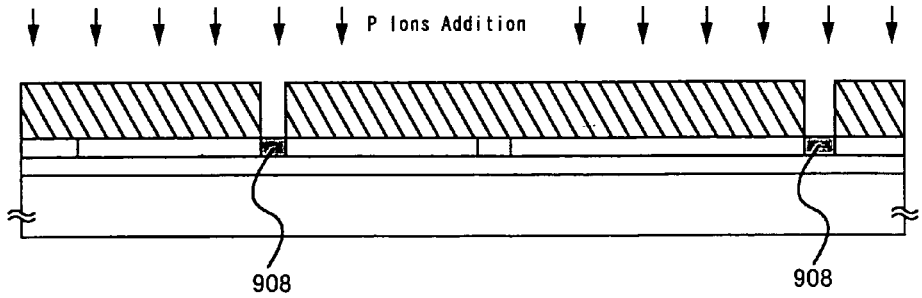

Reference will be made to FIG. 9(D). Then, a catalytic-element gettering process is performed. First, doping with phosphorus ions is selectively performed. Doping with phosphorus ions is performed with the mask insulating film 904 remaining formed. Then, only portions 908 which are not covered with the mask insulating film 904 made of a polycrystalline silicon film are doped with phosphorus (the portions 908 are called the phosphorus-added regions 908). At this time, an acceleration voltage for doping and the thickness of the mask insulating film 904 made of an oxide film are optimized so that phosphorus does not penetrate through the mask insulating film 904. Although the mask insulating film 904 need not necessarily be made of an oxide film, an oxide film is convenient because it does not cause contamination even during direct contact with an active layer.

The dose of phosphorus is preferably approximately $1\times10^{14}$ to $1\times10^{15}$ ions/cm$^2$. In the present embodiment, doping is performed with a dose of $5\times10^{14}$ ions/cm$^2$ by using an ion doping machine.

Incidentally, during the ion doping, acceleration voltage is 10 keV. With an acceleration voltage of 10 keV, phosphorus can hardly pass through the mask insulating film 904 of thickness 150 nm.

Figure 9E:
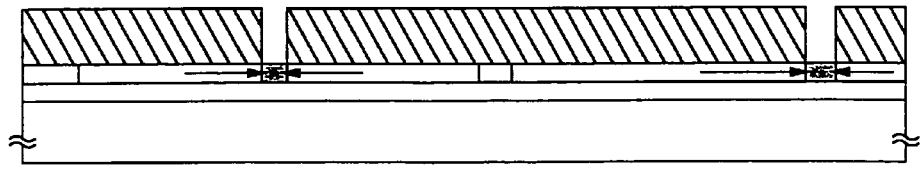

Reference will be made to FIG. 9(E). Then, thermal annealing is performed in a nitrogen atmosphere of 600° C. for 1–12 hours (in the present embodiment, 12 hours), whereby gettering of a nickel element is performed. In this way, nickel is attracted to phosphorus, as indicated by arrows in FIG. 9(E). At a temperature of 600° C., phosphorus atoms hardly move in the film, but nickel atoms can travel by a distance equal to or greater than approximately several hundred μm. It can be understood from this fact that phosphorus is one element which is best suited to gettering of nickel.

Figure 10A:
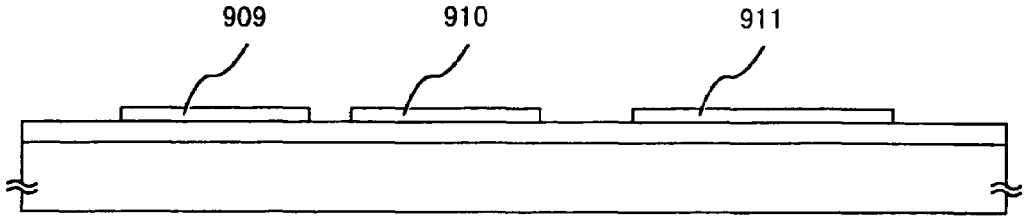
FIGS. 10(A) to 10(C) are views showing the example of the process of fabricating the active matrix liquid crystal display device according to Embodiment 1.

The step of patterning the polycrystalline silicon film will be described below with reference to FIG. 10(A). In this step, it is necessary to completely remove the phosphorus-added regions 908, i.e., regions in which nickel is gettered. In this manner, active layers 909 to 911 made from the polycrystalline silicon film which hardly contain a nickel element are obtained. The obtained active layers 909 to 911 made from the polycrystalline silicon film become active layers for TFTs in a later step.

Figure 10B:
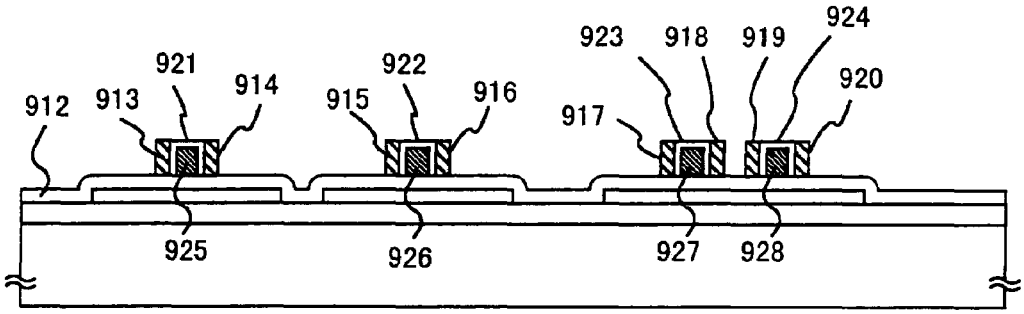

Reference will be made to FIG. 10(B). After the active layers 909 to 911 have been formed, a 70-nm-thick gate insulating film 912 made of a silicon-containing insulating film is formed over the active layers 909 to 911. Then, heat treatment is performed at 800–1100° C. (preferably, 950–1050° C.) in an oxidizing atmosphere, and a thermal oxidation film (not shown) is formed at the interface between each of the active layers 909 to 911 and the gate insulating film 912.

Incidentally, at this stage, the heat treatment for gettering the catalytic element (a catalytic-element gettering process) may also be performed. In this case, the heat treatment makes use of a catalytic-element gettering effect due to a halogen element in a treatment atmosphere which contains the halogen element. It is to be noted that the heat treatment is preferably performed at a temperature exceeding 700° C. so that the catalytic-element gettering effect due to the halogen element can be fully obtained. At a temperature of 700° C. or lower, there is a risk that halogen compounds in the treatment atmosphere become difficult to decompose and the gettering effect becomes impossible to obtain. In this case, representatively, one or plural kinds of gases selected from halogen-containing compounds such as HCl, HF, $NF_3$, HBr, $Cl_2$, $ClF_3$, $BCl_2$, $F_2$ and $Br_2$ can be used as a gas which contains the halogen element. In this step, it is considered that, for example, if HCl is used, nickel in the active layers is gettered by the action of chlorine and is removed by vaporizing into the atmosphere as volatile nickel chloride. If the halogen element is used in the catalytic-element gettering process, the catalytic-element gettering process may also be performed before the active layers are patterned after the mask insulating film 904 is removed. Otherwise, the catalytic-element gettering process may also be performed after the active layers are patterned. In addition, these gettering processes may be arbitrarily combined.

Then, a metallic film (not shown) which essentially consists of aluminum is formed and the original forms of gate electrodes to be described later are formed by patterning. In the present embodiment, an aluminum film which contains 2 wt % scandium is used.

Otherwise, the gate electrodes may be formed by a polycrystalline silicon film to which an impurity for imparting electrical conductivity is added.

Then, the art described in Japanese Patent Laid-Open No. 135318/1995 is used to form porous anodic oxide films 913 to 920, non-porous anodic oxide films 921 to 924 and gate electrodes 925 to 928 (FIG. 10(B)).

Figure 10C:
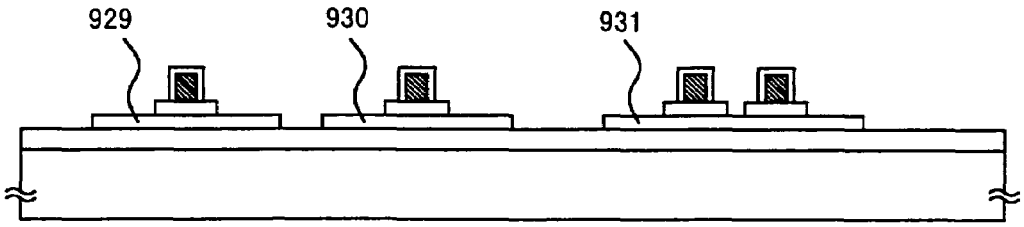

After the state shown in FIG. 10(B) is obtained in the above-described manner, the gate insulating film 912 is etched by using the gate electrodes 925 to 928 and the porous anodic oxide films 913 to 920 as a mask. Then, the porous anodic oxide films 913 to 920 are removed to obtain the state shown in FIG. 10(C). In FIG. 10(C), reference numerals 929 to 931 denote gate insulating films after machining.

Figure 11A:
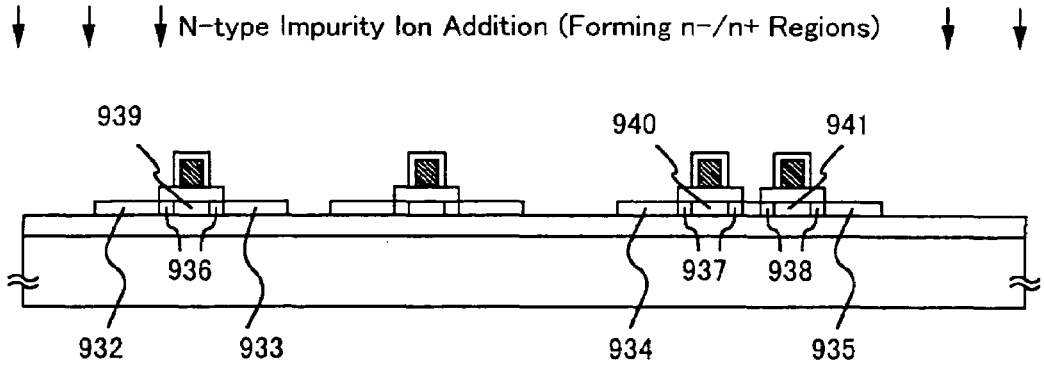
FIGS. 11(A) to 11(C) are views showing the example of the process of fabricating the active matrix liquid crystal display device according to Embodiment 1.

Reference will be made to FIG. 11(A). Then, the step of adding impurity elements each of which imparts one conductivity is performed. P (phosphorus) or As (arsenic) may be used as an impurity element for N-channel TFTs, while B (boron) or Ga (gallium) may be used as an impurity element for P-channel TFTs.

In the present embodiment, the step of adding an impurity for forming N-channel TFTs and the step of adding an impurity for forming P-channel TFTs are respectively performed as two separate steps.

First, the step of adding an impurity for forming N-channel type TFTs is performed. A first impurity adding step (which uses P (phosphorus) in the present embodiment) is performed at a high acceleration voltage of approximately 80 keV, thereby forming n-regions. These n-regions are adjusted so that the concentration of P ions becomes $1\times10^{18}$ atoms/cm$^3$ to $1\times10^{19}$ atoms/cm$^3$.

Then, a second impurity adding step is performed at a low acceleration voltage of approximately 10 keV, thereby forming n+ regions. At this time, since the acceleration voltage is low, the gate insulating films function as a mask. These n+ regions are adjusted so that its sheet resistance becomes 500Ω or less (preferably, 300Ω or less).

Through the above-described steps, a source region 932 and a drain region 933 of an N-channel TFT which constitutes a CMOS circuit, low-concentration impurity regions 936 and a channel type formation region 939 are formed. In addition, a source region 934 and a drain region 935 of an N-channel TFT which constitutes a pixel TFT, low-concentration impurity regions 937, 938 and channel type formation regions 940 and 941 are formed (FIG. 11(A)).

Incidentally, in the state shown in FIG. 11(A), the active layer of a P-channel TFT which constitutes a CMOS circuit has the same construction as the active layer of each of the N-channel TFTs.

Figure 11B:
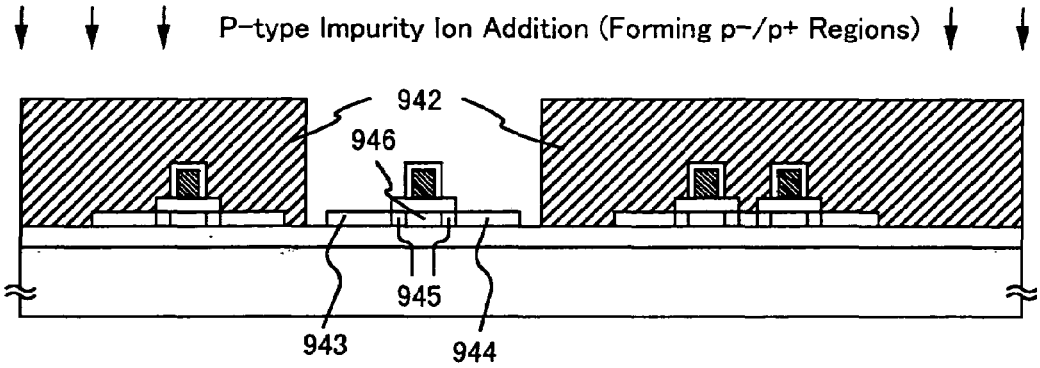

Then, as shown in FIG. 11(B), a resist mask 942 which covers the N-channel TFTs is provided and impurity ions (boron is used in the present embodiment) which impart P-type conductivity are added.

Although this step is performed in two separate steps similarly to the above-described impurity adding step, B (boron) ions are added at a concentration several times as high as that of the above-described P ions because it is necessary to invert an N-channel type to a P-channel type.

In this manner, a source region 943 and a drain region 944 of the P-channel TFT which constitutes a CMOS circuit, a low-concentration impurity region 945 and a channel formation region 946 are formed (FIG. 11(B)).

If the gate electrodes are formed of a polycrystalline silicon film to which an impurity for imparting electrical conductivity is added, a known sidewall structure may be used to form the low-concentration impurity regions.

Then, activation of impurity ions are performed by a combination of furnace annealing, laser annealing, lamp annealing and the like. At the same time, damage caused to the active layers in the adding steps is repaired.

Figure 11C:
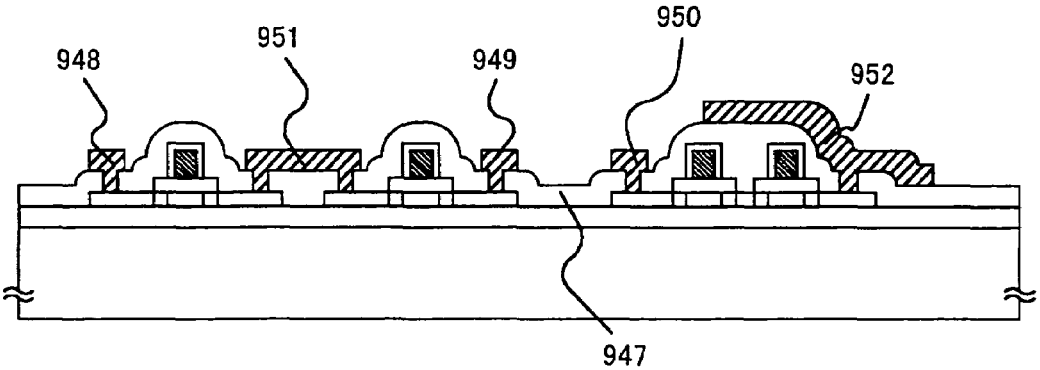

Reference will be made to FIG. 11(C). Then, a stacked film made of a silicon oxide film and a silicon nitride film is formed as a first interlayer insulating film 947. After contact holes are formed in the first interlayer insulating film 947, source electrodes 948, 949 and 950 and drain electrodes 951 and 952 are formed. Incidentally, an organic resin film can also be used as the first interlayer insulating film 947.

Figure 12A:
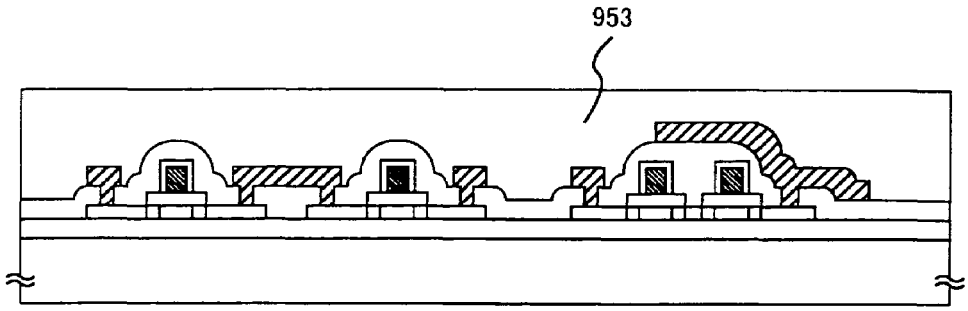
FIGS. 12(A) to 12(C) are views showing the example of the process of fabricating the active matrix liquid crystal display device according to Embodiment 1.

Reference will be made to FIG. 12(A). Then, a second interlayer insulating film 953 made of an organic resin film is formed to a thickness of 0.5–3 μm. Polyimide, acrylic, polyimide amide and the like are used as the organic resin film. The organic resin film has a number of advantages such as the advantages that its film formation method is simple; its film thickness can readily be increased; its parasitic capacitor can be reduced because of its low dielectric constant; and its flatness is superior. Incidentally, an organic resin film other than the above-described ones can also be used.

Then, part of the second interlayer insulating film 953 is etched, and a black matrix 954 is formed above the drain electrode 952 of the pixel TFT with the second interlayer insulating film 953 interposed therebetween. In the present embodiment, Ti (titanium) is used for the black matrix 954. Incidentally, in the present embodiment, an auxiliary capacitor is formed between the pixel TFT and the black matrix 954. A third interlayer insulating film 955 is formed. Silicon oxide, silicon nitride or an organic resin such as polyimide or acrylic resin may be used.

Then, contact holes are formed in the second interlayer insulating film 953, and a pixel electrode 956 of thickness 120 nm is formed. Incidentally, since the present embodiment is an example of a transmission type of active matrix liquid crystal display device, a transparent conductive film such as ITO is used as a conductive film which constitutes the pixel electrode 956.

Then, the entire substrate is heated in a hydrogen atmosphere of 350° C. for 1–2 hours to effect hydrogenation of the entire device, thereby compensating for dangling bonds (unpaired electrons) in the film (particularly, in the active layers). Through the above-described steps, an active matrix substrate which has CMOS circuits and a pixel matrix circuit on one substrate is finished.

The process of fabricating an active matrix liquid crystal display device on the basis of the active matrix substrate fabricated through the above-described steps will be described below.

Figure 12B:
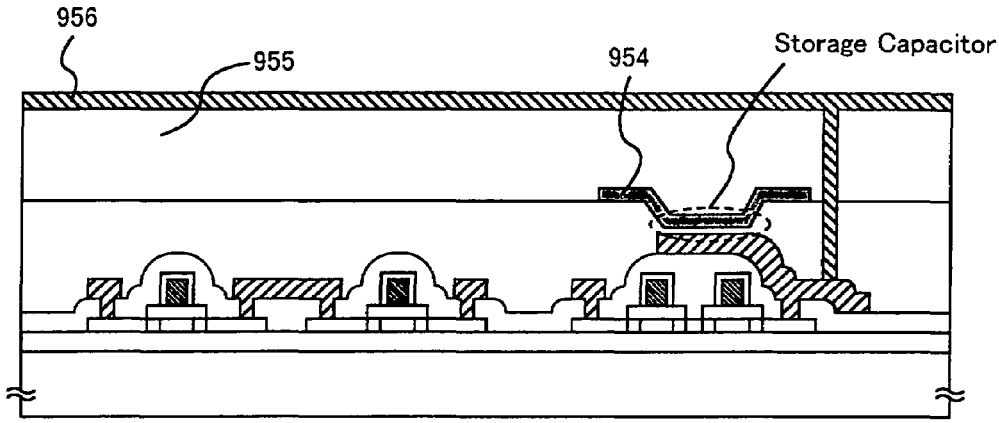

An alignment film 957 is formed over the active matrix substrate which is in the state shown in FIG. 12(B). In the present embodiment, polyimide is used for the alignment film 957. Then, a counter substrate is prepared. The counter substrate is made of a glass substrate 958, a counter electrode 959 made of a transparent conductive film and an alignment film 960.

Incidentally, in the present embodiment, a polyimide film is used as the alignment film 957. Incidentally, rubbing is performed after the alignment film 957 is formed. Incidentally, in the present embodiment, polyimide having a comparatively large pretilt angle is used for the alignment film 957.

Then, the active matrix substrate and the counter substrate which have passed through the above-described steps are bonded together with a seal material and a spacer (neither of which is shown) interposed therebetween, by a known cell assembly process. After that, a liquid crystal 961 is charged between both substrates, and they are completely sealed by a sealant (not shown). In the present embodiment, a nematic liquid crystal is used as the liquid crystal 961.

Figure 12C:
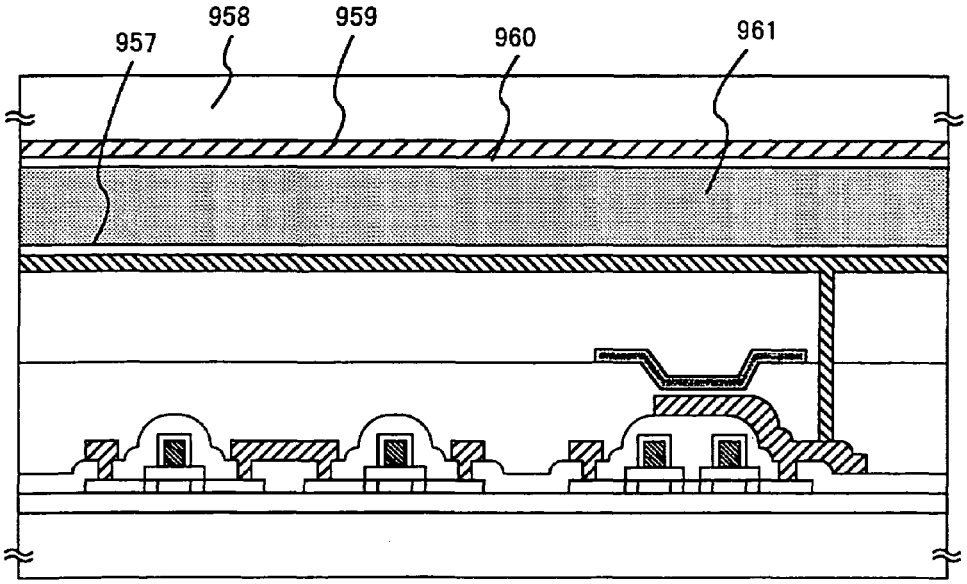

Thus, a transmission type of active matrix liquid crystal display device such as that shown in FIG. 12(C) is finished.

Incidentally, the crystallization of the amorphous silicon film 903 may be performed with a laser beam (representatively, an excimer laser beam) instead of the amorphous-silicon-film crystallizing method described above in connection with the present embodiment.

Embodiment 2

In the description of the present embodiment, reference will be made to an example in which inverted stagger TFTs are used for an active matrix liquid crystal display device which can realize the driving method according to the present invention.

Figure 13:
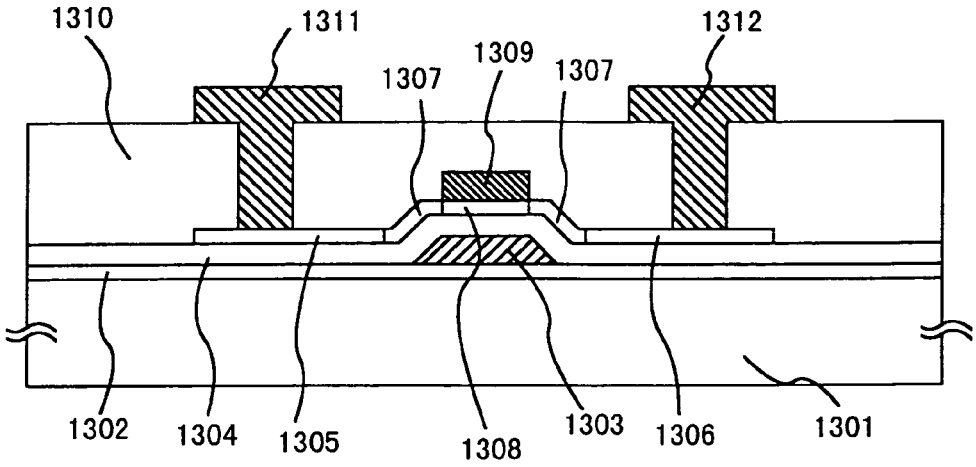
FIG. 13 is a cross-sectional view of an inverted stagger TFT which constitutes an active matrix liquid crystal display device according to Embodiment 2.

Reference will be made to FIG. 13. FIG. 13 shows a cross-sectional view of an inverted stagger N-channel TFT which constitutes part of the active matrix liquid crystal display device of the present embodiment. Needless to say, although FIG. 13 shows only one N-channel TFT, it is possible to construct a CMOS circuit with a P-channel TFT and an N-channel TFT as in the case of Embodiment 1. In addition, it goes without saying that each pixel TFT can be formed to have a similar construction.

Reference numeral 1301 denotes a substrate, and a substrate such as that described above in connection with Embodiment 1 is used as the substrate 1301. Reference numeral 1302 denotes a silicon oxide film. Reference numeral 1303 denotes a gate electrode. Reference numeral 1304 denotes a gate insulating film. Reference numerals 1305, 1306, 1307 and 1308 denote active layers made from a polycrystalline silicon film. In the fabrication of these active layers 1305, 1306, 1307 and 1308, a method which is similar to the polycrystallization of an amorphous silicon film described above in connection with Embodiment 1 is used. It is also possible to adopt a method of crystallizing an amorphous silicon film by means of a laser beam (preferably, a linear laser beam or a planar laser beam). In FIG. 13, reference numeral 1305 denotes a source region, reference numeral 1306 denotes a drain region, reference numeral 1307 denotes low-concentration impurity regions (LDD regions), and reference numeral 1308 denotes a channel formation region. Reference numeral 1309 denotes a channel protection film, and reference numeral 1310 denotes an interlayer insulating film. Reference numerals 1311 and 1312 denote a source electrode and a drain electrode, respectively.

Embodiment 3

In the description of the present embodiment, reference will be made to an example in which an active matrix liquid crystal display device is made of inverted stagger TFTs which differ in construction from those of Embodiment 3.

Figure 14:
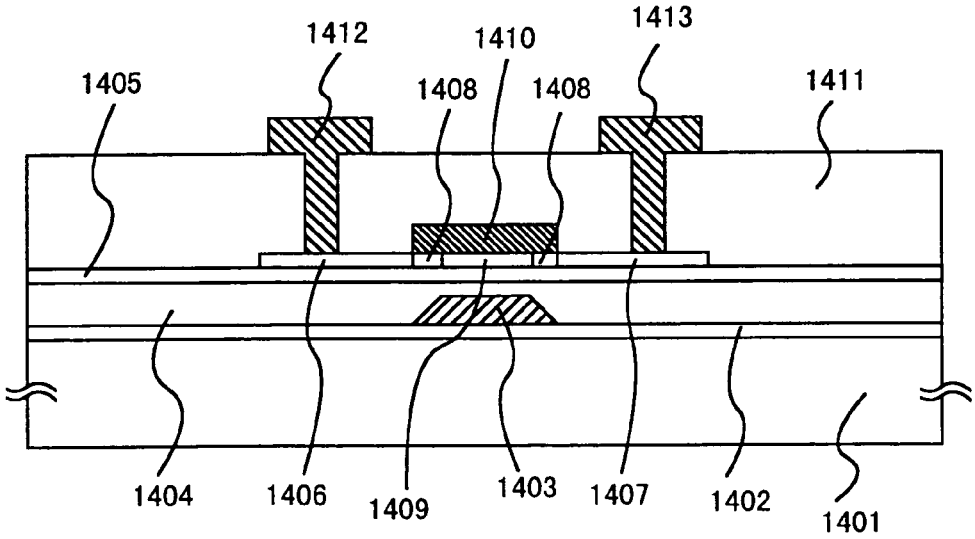
FIG. 14 is a cross-sectional view of an inverted stagger TFT which constitutes an active matrix liquid crystal display device according to Embodiment 3.

Reference will be made to FIG. 14. FIG. 14 shows a cross-sectional view of an inverted stagger N-channel TFT which constitutes part of the active matrix liquid crystal display device of the present embodiment. Needless to say, although FIG. 14 shows only one N-channel TFT, it is possible to construct a CMOS circuit with a P-channel TFT and an N-channel TFT as in the case of Embodiment 1. In addition, it goes without saying that each pixel TFT can be formed to have a similar construction.

Reference numeral 1401 denotes a substrate, and a substrate such as that described above in connection with Embodiment 1 is used as the substrate 1401. Reference numeral 1402 denotes a silicon oxide film. Reference numeral 1403 denotes a gate electrode. Reference numeral 1404 denotes a benzodiclobutene (BCB) film whose top surface is flattened. Reference numeral 1405 denotes a silicon nitride film. The BCB film 1404 and the silicon nitride film 1405 constitute a gate insulating film. Reference numerals 1406, 1407, 1408 and 1409 denote active layers made from a polycrystalline silicon film. In the fabrication of these active layers 1406, 1407, 1408 and 1409, a method which is similar to the polycrystallization of an amorphous silicon film described above in connection with Embodiment 1 is used. It is also possible to adopt a method of crystallizing an amorphous silicon film by means of a laser beam (preferably, a linear laser beam or a planar laser beam). In FIG. 14, reference numeral 1406 denotes a source region, reference numeral 1407 denotes a drain region, reference numeral 1408 denotes low-concentration impurity regions (LDD regions), and reference numeral 1409 denotes a channel formation region. Reference numeral 1410 denotes a channel protection film, and reference numeral 1411 denotes an interlayer insulating film. Reference numerals 1412 and 1413 denote a source electrode and a drain electrode, respectively.

According to the present embodiment, since the gate insulating film made of the BCB film and the silicon nitride film is flattened, the amorphous silicon film formed over the gate insulating film is also flattened. Accordingly, in the poly-crystallization of the amorphous silicon film, it is possible to obtain a polycrystalline silicon film more uniform than in a conventional inverted stagger TFT.

Embodiment 4

Figure 19:
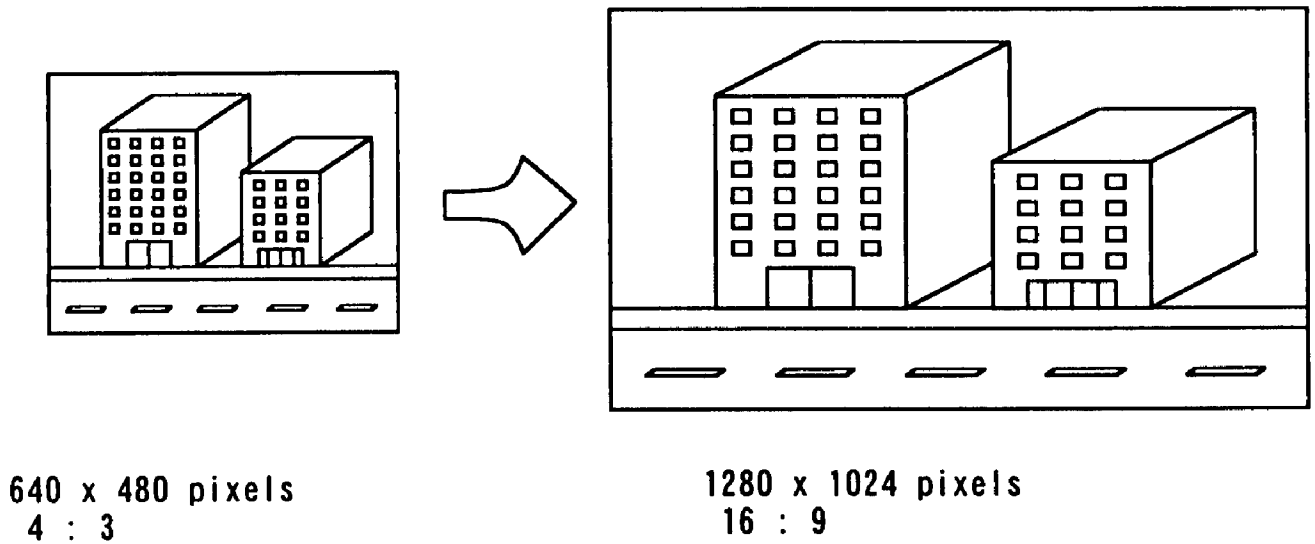
FIG. 19 is a conceptual diagram of the way of displaying a low-resolution video image on an active matrix semiconductor display device capable of coping with high resolution.

In the description of the present embodiment, reference will be made to a driving method for format conversion which displays an image signal which conforms to a low-resolution standard such as VGA (640×480 pixels) or SVGA (800×600 pixels), on an active matrix liquid crystal display device which conforms to a high-resolution standard such as SXGA (1280×1024 pixels). FIG. 19 shows a conceptual diagram of a display to be provided by the present embodiment. It is to be noted that according to the driving method of the present invention, it is also possible to display an image signal which conforms to a lower-resolution standard than a high-resolution standard other than SXGA, on an active matrix liquid crystal display device which conforms to such high-resolution standard.

Figure 20:
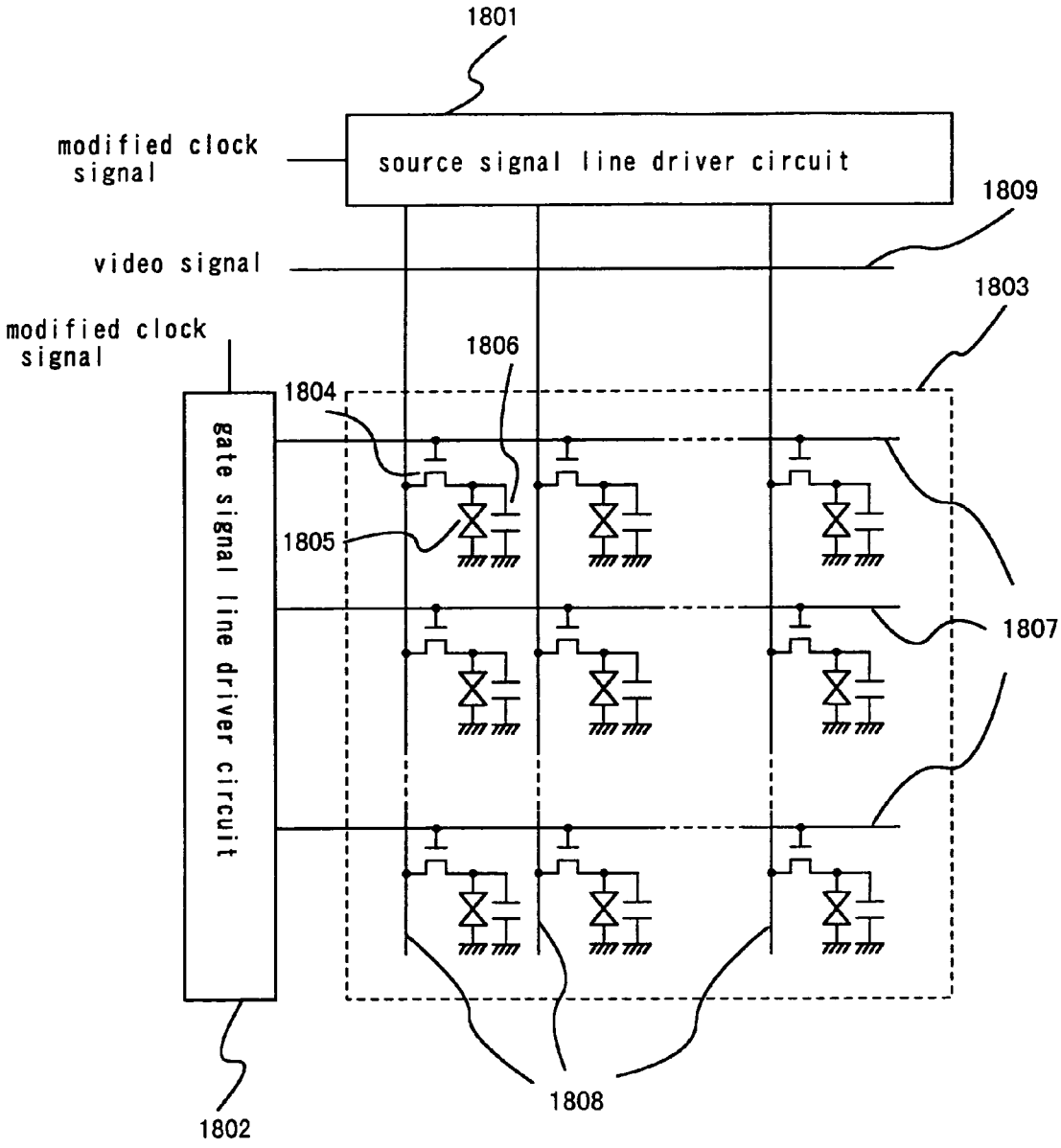
FIG. 20 is a schematic block diagram of an active matrix liquid crystal display device according to Embodiment 4.

For example, consideration will be given to a case in which an image signal which conforms to VGA (640×480 pixels) is displayed on an active matrix liquid crystal display device which conforms to SXGA (1280×1024 pixels). In the driving method of the present embodiment, a modulated clock signal is supplied to not only a source signal line-side driving circuit but also a gate signal line-side driving circuit. FIG. 20 shows a schematic block diagram of the active matrix liquid crystal display device of the present embodiment. Reference numeral 1801 denotes a source signal line-side driving circuit to which a modulated clock signal, a start pulse and the like are to be inputted. Reference numeral 1802 denotes a gate signal line-side driving circuit to which a modulated clock signal, a start pulse and the like are to be inputted. Reference numeral 1803 denotes an active matrix circuit which has pixels arranged in a matrix form so that one pixel is disposed at each of the intersections of gate signal lines 1807 and source signal lines 1808. Each of the pixels has a thin-film transistor 1804, and a pixel electrode (not shown) and an auxiliary capacitor 1806 are connected to the drain electrode of the thin-film transistor 1804. Reference numeral 1805 denotes a liquid crystal sandwiched between the active matrix circuit 1803 and a counter substrate (not shown). Reference numeral 1809 denotes a video signal line to which a video signal is to be externally inputted.

Figure 21:
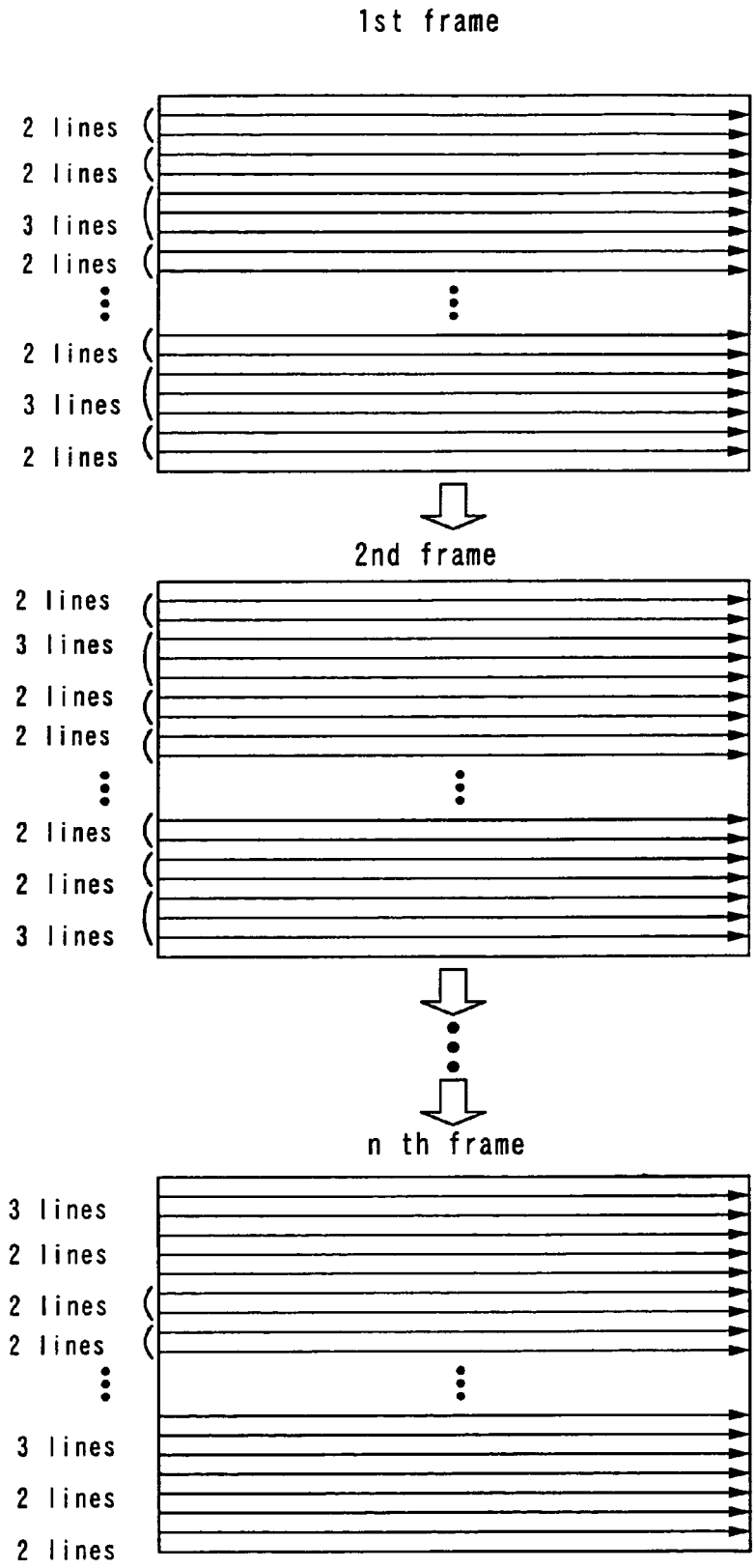
FIG. 21 is a view showing display examples of the active matrix liquid crystal display device according to Embodiment 4.
Figure 22:
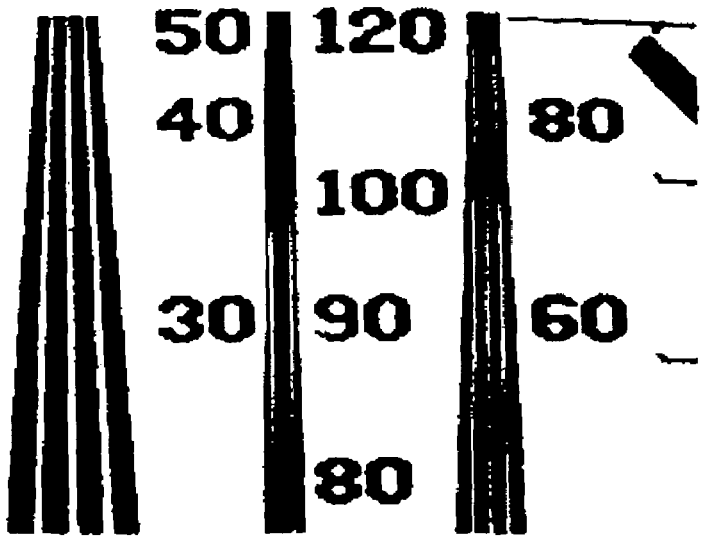
FIG. 22 is a photographic view of a video image of a resolution measuring relative to a CRT.
Figure 23:
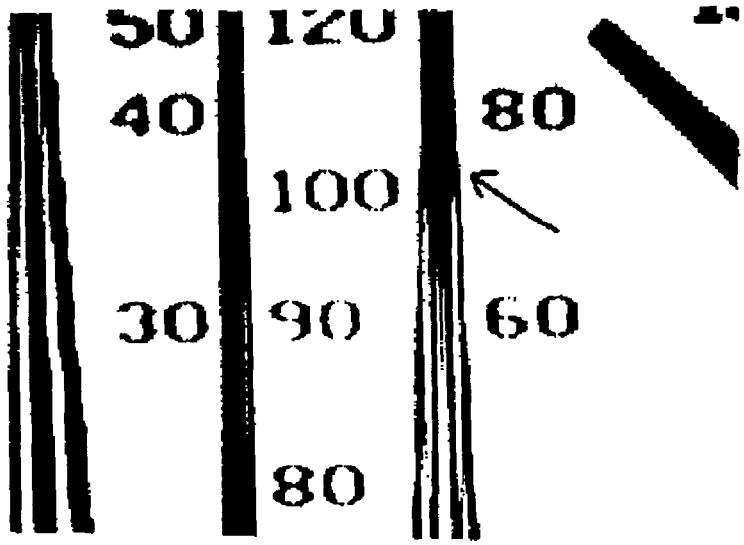
FIG. 23 is a photographic view of a video image of a resolution measuring relative to a rear projector in which a conventional active matrix liquid crystal display device is incorporated.

Reference will be made to FIG. 21. FIG. 21 shows, in the sequence of frames, screen images which are displayed on the active matrix liquid crystal display device of the present embodiment on a frame-by-frame basis by the driving method according to the present invention. In the present embodiment, the frequency of the modulated clock signal to be inputted to the source signal line-side driving circuit 1801 is lowered to ½ so that a horizontal image size is converted (frequency expansion). In the gate signal line-side driving circuit 1802, the frequency of the modulated clock signal to be inputted is reduced to ½ to select two lines at the same time and convert a vertical image size, and simultaneous selection of three lines is carried out with a certain probability by a shift of the frequency of the modulated clock signal. In this manner, it is possible to completely effect conversion of an image size which cannot be completely converted, merely by lowering the frequency.

As shown in FIG. 21, the first frame, the second frame, . . . and the n-th frame differ from one another in the timing of simultaneous writing of three lines. By controlling the timing of simultaneous writing of three lines by means of the shift of the frequency of the modulated clock signal, complete format conversion is realized (for example, from an aspect ratio of 4:3 to an aspect ratio of 16:9).

In addition, in the case where modulated clocks are inputted to the source signal line-side driving circuit 1801 and the gate signal line-side driving circuit 1802 to execute format conversion of the screen, fixed clocks may be used for writing an image to the central portion of the screen, and an image size may also be converted by frequency expansion or modulated clocks from the central portion of the screen toward the periphery thereof.

Embodiment 5

In the description of the present embodiment, reference will be made to a case in which a modulated clock signal is used in an active matrix liquid crystal display device having a digital driving circuit. In the active matrix liquid crystal display device of the present embodiment, an analog image signal such as a high-definition television signal or an NTSC signal to be externally supplied is converted into a digital image signal by A/D conversion (analog/digital conversion). The sampling of the analog image signal during the A/D conversion is performed by using the modulated clock signal. The digital image signal is subjected to digital signal processing such as gamma correction and aperture control, and is then converted into an improved analog image signal by D/A conversion (digital/analog conversion) using a fixed clock. The improved analog image signal is written to its corresponding pixels. In this manner, the digital signal processing of an image signal can be effected, whereby an observer can obverse the image signal as an image with resolution which is apparently improved, as described above in connection with the aforesaid mode for carrying out the present invention as well as the aforesaid embodiments of the same.

The following method is available as another driving method according to the present embodiment. An analog image signal such as a high-definition television signal or an NTSC signal to be externally supplied is converted into a digital image signal by A/D conversion (analog/digital conversion) at sampling timing due to a fixed clock signal. The digital image signal is subjected to digital signal processing such as gamma correction and aperture control, and is then converted into an improved analog signal image by D/A conversion using a modulated clock signal. The improved analog image signal is written to its corresponding pixels. In this manner, the digital signal processing of an image signal can be effected, whereby an observer can observe the image signal as an image with resolution which is apparently improved, as described above in connection with the aforesaid mode for carrying out the present invention as well as the aforesaid embodiments of the same. In this driving method, the sampling of the analog image signal during the A/D conversion may also be performed with a modulated clock signal.

Embodiment 6

Figure 24:
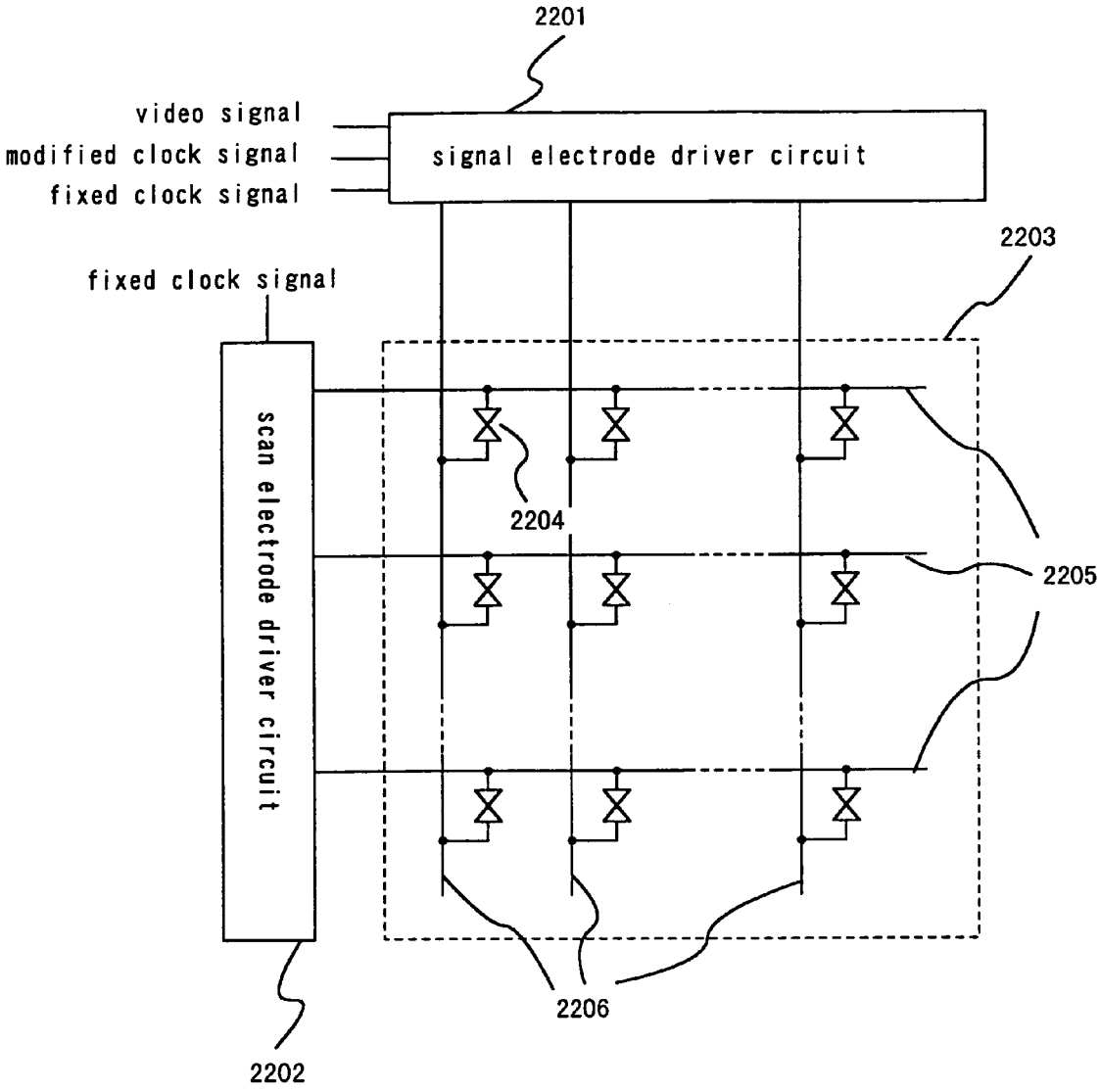
FIG. 24 is a schematic block diagram of a passive matrix liquid crystal display device according to Embodiment 6.

In the description of the present embodiment, reference will be made to a case in which the driving method using the modulated clock signal according to the present invention is used in a passive matrix liquid crystal display device Reference will be made to FIG. 24. FIG. 24 shows a schematic block diagram of a passive matrix liquid crystal display device in the present embodiment. Reference numeral 2201 denotes a signal electrode driving circuit to which a video signal and a modulated clock signal are to be externally inputted. Reference numeral 2202 denotes a scanning electrode driving circuit to which a fixed clock signal is to be externally inputted. Reference numeral 2203 denotes a passive matrix circuit having a matrix electrode structure in which linear signal electrodes 2206 and linear scanning electrodes 2205 make right angles to one another. A liquid crystal 2204 is sandwiched between these electrodes 2206 and 2205.

The modulated clock signal is inputted to the signal electrode driving circuit 2201, and the video signal is sampled and converted into a digital image signal A/D conversion by the modulated clock signal and the digital image signal is temporarily stored in a video memory as described previously in connection with the mode for carrying out the present invention. After that, the digital image signal may also be subjected to digital signal processing. Then, the digital image signal is D/A-converted into image information by the fixed clock signal, and the image information is written to its corresponding signal electrodes 2206. In addition, the fixed clock signal is inputted to the scanning electrode driving circuit 2202, and the scanning electrode driving circuit 2202 supplies scanning signals to the scanning electrodes 2205.

In the passive matrix liquid crystal display device of the present embodiment as well, since the outline portion of an image has shading information, it is possible to obtain effects similar to those obtainable in the active matrix liquid crystal display device of the above-described embodiment.

Incidentally, in the passive matrix liquid crystal display device of the present embodiment as well, it is possible to execute the format conversion method using a modulated clock which has previously been described as Embodiment 4. In this case, the modulated clock is also inputted to the scanning electrode driving circuit 2202.

Embodiment 7

In the active matrix liquid crystal display device or the passive matrix liquid crystal display device of the above-described embodiments, a TN mode using a nematic liquid crystal is used as a display mode, but another display mode can also be used.

Furthermore, a thresholdless antiferroelectric or ferroelectric liquid crystal with fast response time may be used to constitute an active matrix liquid crystal display device.

For example, it is possible to use liquid crystals which are disclosed in 1998, SID, "Characteristics and Driving Scheme of Polymer-Stabilized Monostable FLCD Exhibiting Fast Response Time and High Contrast Ratio with Gray-Scale Capability" by H. Furue et al.; 1997, SID DIGEST, 841, "A Full-Color Thresholdless Antiferroelectric LCD Exhibiting Wide Viewing Angle with Fast Response Time" by T. Yoshida et al.; 1996, J. Mater. Chem. 6(4), 671–673, "Thresholdless antiferroelectricity in liquid crystals and its application to displays" by S. Inui et al.; and U.S. Pat. No. 5,594,569.

A liquid crystal which exhibits an antiferroelectric phase in a particular temperature range is called an antiferroelectric liquid crystal. Among mixed liquid crystals which have antiferroelectric liquid crystals, there are thresholdless antiferroelectric mixed liquid crystals which exhibit electro-optic response characteristics which allow transmittance to continuously vary with respect to an electric field. Some thresholdless antiferroelectric mixed liquid crystals exhibit V-shaped electro-optic response characteristics, and it has been discovered that a thresholdless antiferroelectric mixed liquid crystal has a driving voltage of approximately ±2.5 V (cell thickness about 1 μm to 2 μm).

Figure 31:
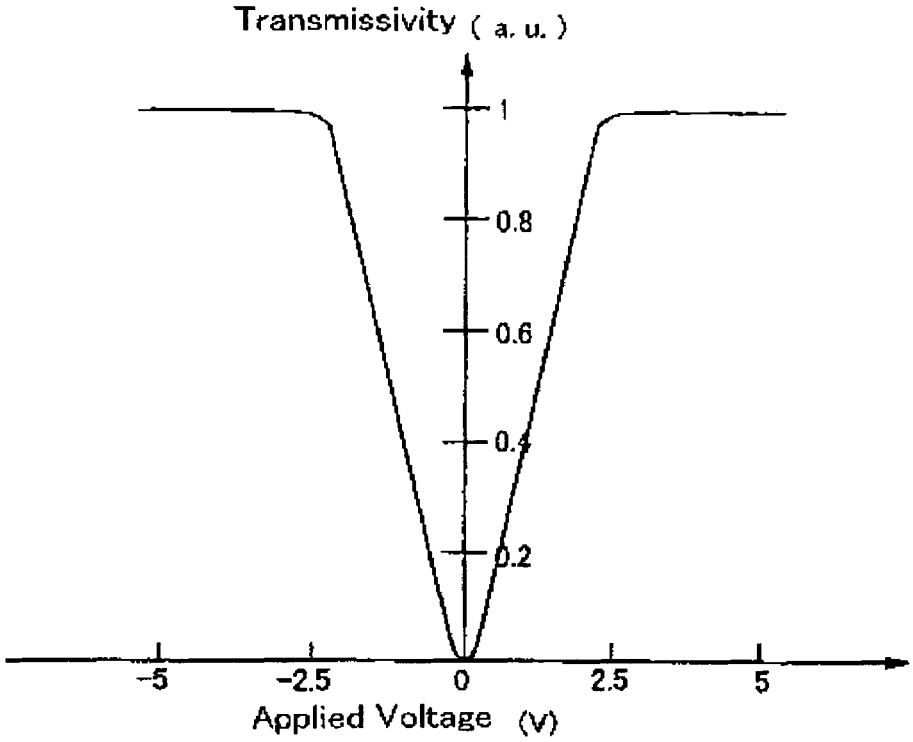
FIG. 31 is a graph showing an applied voltage-transmittance characteristic example of a thresholdless antiferroelectric mixed liquid crystal.

FIG. 31 shows a characteristic example of light transmittance of a thresholdless antiferroelectric mixed liquid crystal which exhibits a V-shaped electro-optic response, with respect to the voltage applied to the same. In the graph shown in FIG. 31, the vertical axis represents transmittance (arbitrary unit) and the horizontal axis represents applied voltage. It is to be noted that the transmittance axis of a polarizer located on an incidence side of the active matrix liquid crystal display device is set approximately in parallel with the direction of a normal to the smectic layer of the thresholdless antiferroelectric mixed liquid crystal, which direction approximately coincides with the rubbing direction of the active matrix liquid crystal display device. The transmittance axis of a polarizer located on an exit side of the active matrix liquid crystal display device is set approximately at right angles (cross nicol) to the transmittance axis of the polarizer on the incidence side.

As shown in FIG. 31, it is apparent that the use of such a thresholdless antiferroelectric mixed liquid crystal enables low-voltage driving and gray-scale display.

If such a low-voltage drive thresholdless antiferroelectric mixed liquid crystal is used as an active matrix liquid crystal display device having the driving circuit of the present invention, the source voltage of an image signal sampling circuit can be reduced to, for example, approximately 5 V to 8 V. Thus, it is possible to lower the operating source voltage of a driver and realize higher reliability and lower 4 power consumption in the active matrix liquid crystal display device.

Accordingly, the use of the low-voltage drive thresholdless antiferroelectric mixed liquid crystal is effective even in a case which uses TFTs each having an LDD region (low-concentration impurity region) of comparatively small width (for example, 0 nm to 500 nm or 0 nm to 200 nm).

In general, the thresholdless antiferroelectric mixed liquid crystal is large in spontaneous polarization and the dielectric constant of its liquid crystal itself is high. For this reason, if the thresholdless antiferroelectric mixed liquid crystal is used in the active matrix liquid crystal display device, each pixel needs a comparatively large storage capacity. Therefore, it is preferable to use a thresholdless antiferroelectric mixed liquid crystal having small spontaneous polarization.

It is to be noted that since low-voltage driving is realized by the use of the thresholdless antiferroelectric mixed liquid crystal, low power consumption is realized in the active matrix liquid crystal display device.

It is to be noted that any kind of liquid crystal having an electro-optic characteristic such as that shown in FIG. 29 can be used as a display medium of an active matrix liquid crystal display device which uses the driving circuit according to the present invention.

In addition, any other kind of display medium whose optical characteristics can be modulated in response to applied voltage can be used in an active matrix semiconductor display device which uses the driving circuit according to the present invention. For example, an electroluminescence element or the like may be used.

In addition, instead of TFTs, MIM elements or the like may be used as active elements in an active matrix circuit of the active matrix liquid crystal display device.

Embodiment 8

An active matrix semiconductor display device or passive matrix semiconductor display device of the type which uses the driving circuit according to the present invention have various uses. In the description of the present embodiment, reference will be made to a semiconductor device in which is incorporated an active matrix semiconductor display device or passive matrix semiconductor display device (referred to as the semiconductor display device) which uses the driving circuit according to the present invention.

Such a semiconductor display device is known as a video camera, a still camera, a projector, a head-mounted display, a car navigation system, a personal computer, and a mobile information terminal (such as a mobile computer or a mobile telephone). One example of the semiconductor display device is shown in FIGS. 15(A) to 16(E).

Figure 15A:
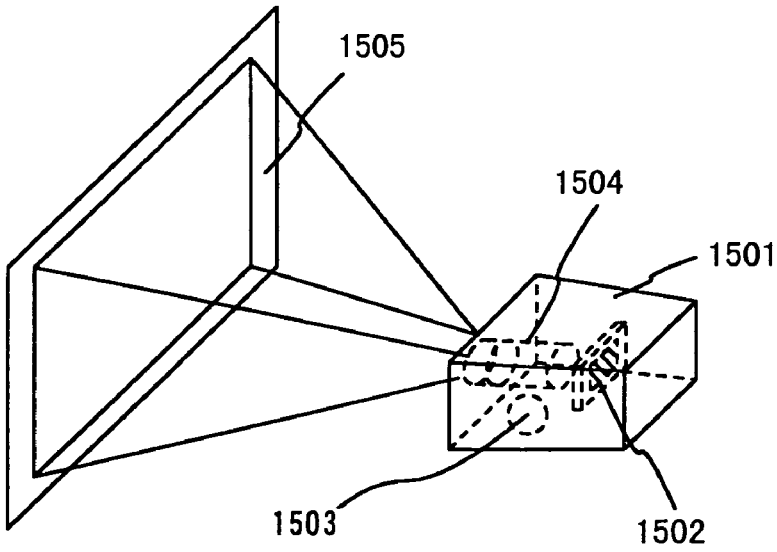
FIGS. 15(A) and 15(B) are views showing different examples in which active matrix liquid crystal display devices using a driving method according to the present invention are incorporated in a front projector and a rear projector, respectively.

FIG. 15(A) shows a front projector which is made of a body 1501, a semiconductor display device 1502 (representatively, a liquid crystal device), a light source 1503, an optical system 1504 and a screen 1505. Although a front projector in which one semiconductor display device is incorporated is shown in FIG. 15(A), it is also possible to realize a higher-resolution and higher-definition front projector by incorporating three semiconductor display devices (for R light, G light and B light).

Figure 15B:
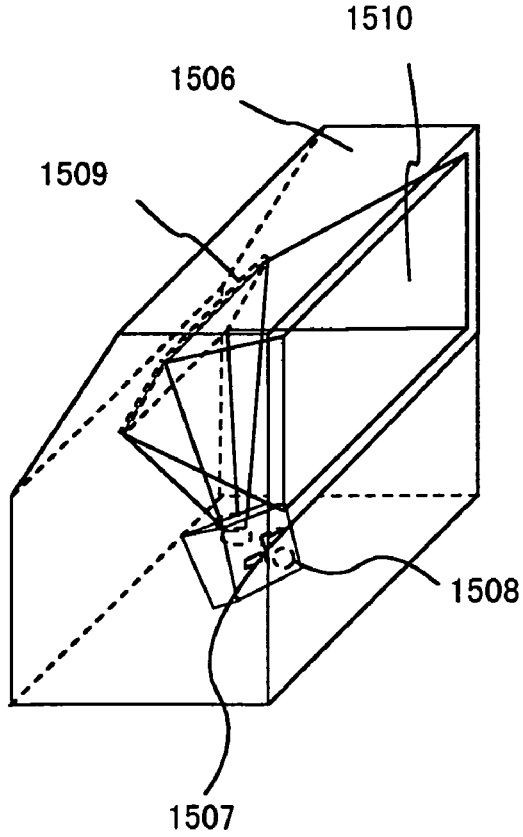

FIG. 15(B) shows a rear projector which is made of a body 1506, a liquid crystal display device 1507, a light source 1508, a reflector 1509 and a screen 1510. Incidentally, three semiconductor display devices (for R light, G light and B light) are incorporated in the rear projector shown in FIG. 15(B).

Figure 16A:
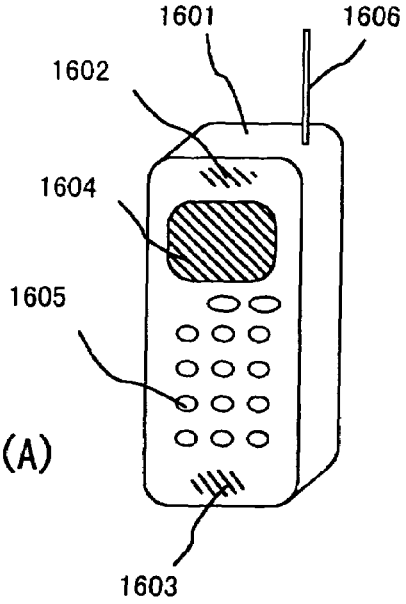

FIG. 16(A) shows a mobile telephone which is made of a body 1601, a voice output part 1602, a voice input part 1603, a semiconductor display device 1604, operating switches 1605 and an antenna 1606.

Figure 16B:
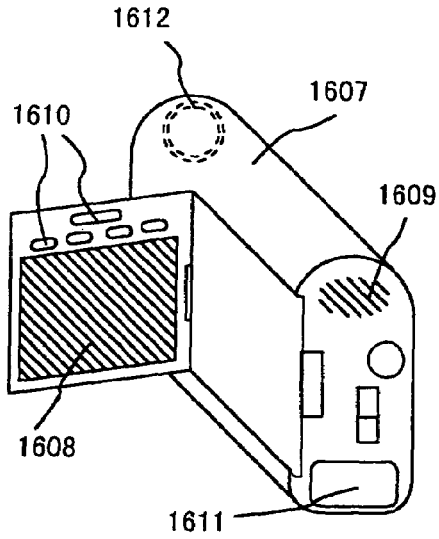

FIG. 16(B) shows a video camera which is made of a body 1607, a semiconductor display device 1608, a voice input part 1609, operating switches 1610, a battery 1611 and an image receiving part 1612.

Figure 16C:
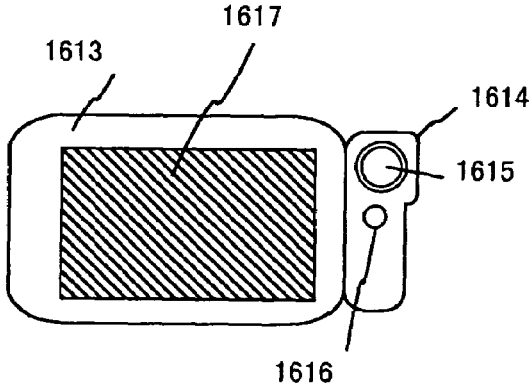

FIG. 16(C) shows a mobile computer which is made of a body 1613, a camera part 1614, an image receiving part 1615, an operating switch 1616 and a semiconductor display device 1617.

Figure 16D:
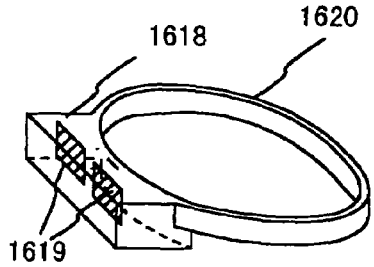

FIG. 16(D) shows a head-mounted display which is made of a body 1618, a semiconductor display device 1619 and a band part 1620.

Figure 16E:
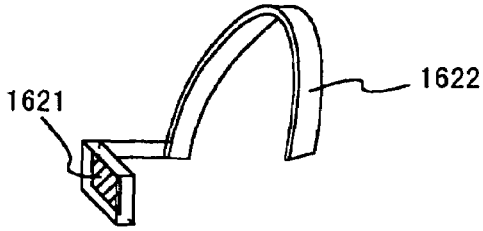

FIG. 16(E) shows a one-eyed head-mounted display which is made of a semiconductor display device 1621 and a band part 1622.

Figure 17A:
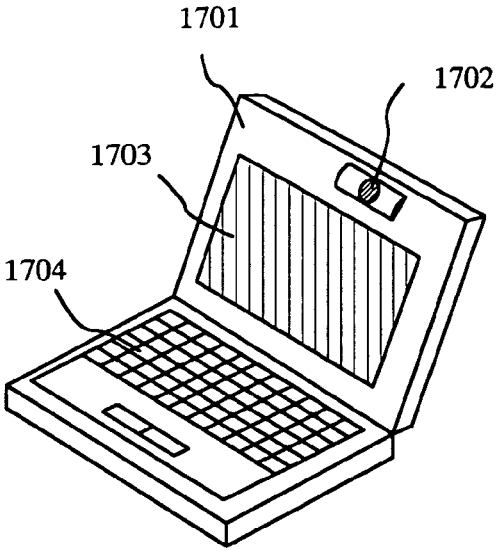

FIG. 17(A) shows a personal computer which is made of a body 1701, an image input part 1702, a semiconductor display device 1713 and a keyboard 1704. The present invention can be applied to the semiconductor display device.

Figure 17B:
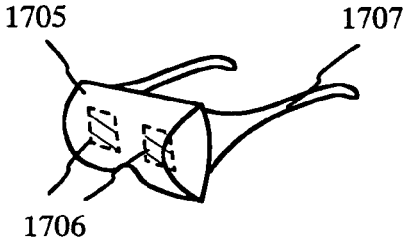

FIG. 17(B) shows a goggles-type display which is made of a body 1705, a semiconductor display device 1706 and arm parts 1707. The present invention can be applied to the semiconductor display device 1705.

Figure 17C:
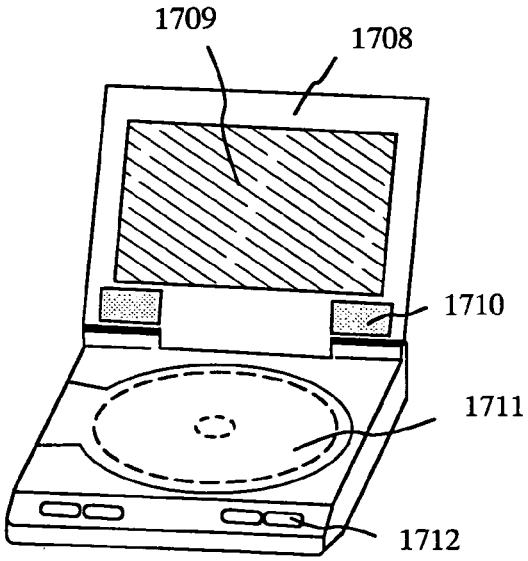

FIG. 17(C) shows a player which uses a recording medium on which a program is recorded (hereinafter referred to as the recording medium), and the player is made of a body 1708, a semiconductor display device 1709, speaker parts 1710, a recording medium 1711 and operating switches 1712. Incidentally, this player uses a DVD (Digital Versatile Disc), a CD or the like as the recording medium and enables a user to enjoy music, a movie, a game or the Internet. The present invention can be applied to the semiconductor display device 1709.

Figure 17D:
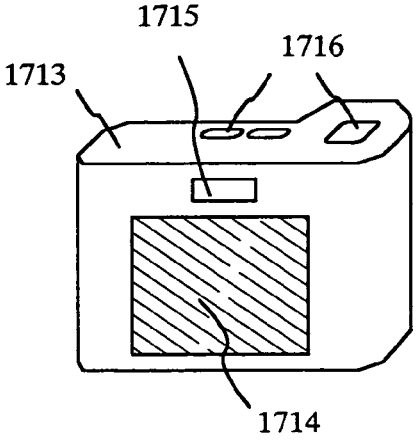

FIG. 17(D) shows a digital camera which is made of a body 1713, a semiconductor display device 1714, an eyepiece part 1715, operating switches 1716 and an image receiving part (not shown). The present invention can be applied to the semiconductor display device 1714.

FIG. 18(A) shows a front projector which is made of a display device 2601 and a screen 2602. The present invention can be applied to the display device 2601.

FIG. 18(B) shows a rear projector which is made of a body 2701, a display device 2702, a mirror 2703 and a screen 2704. The present invention can be applied to the display device 2702.

FIG. 18(C) is a view showing one example of the structure of each of the display devices 2601 and 2702 shown in FIGS. 18(A) and 18(B). Each of the display devices 2601 and 2702 is made of a light-source optical system 2801, mirrors 2802 and 2804 to 2806, dichroic mirrors 2803, a prism 2807, liquid crystal display devices 2808, phase-difference plates 2809 and a projection optical system 2810. The projection optical system 2810 is made of an optical system including a projection lens. Although the shown example is provided with three display devices, the present invention is not particularly limited to such example and may also be applied to a system having a single display device. In addition, a user may arrange optical systems, such as an optical lens, a film having a polarization function, a film for adjusting phase difference and an IR film, at appropriate locations along the optical paths shown by arrows in FIG. 18(C).

FIG. 18(D) is a view showing one example of the structure of the light-source optical system 2801 shown in FIG. 18(C). In the example shown in FIG. 18(D), the light-source optical system 2801 is made of a reflector 2811, a light source 2812, lens arrays 2813 and 2814, a polarizing conversion element 2815 and a condenser lens 2816. The light-source optical system 2801 shown in FIG. 18(D) is merely one example, and the present invention is not particularly limited to only this example. For example, the user may arrange optical systems, such as an optical lens, a film having a polarization function, a film for adjusting phase difference and an IR film, at appropriate locations in the light-source optical system 2801.

As described above, the range of application of the present invention is extremely wide, and the present invention can be applied to all fields of electronic apparatuses. In addition, even if a construction made of a combination of any arbitrary ones of Embodiments 1 to 7 is used, it is possible to realize the electronic apparatuses of Embodiment 8.

Embodiment 9

In the description of the present embodiment, reference will be made to a fabrication method which differs from the method of fabricating the active matrix liquid crystal display device described previously in connection with Embodiment 1. Incidentally, an active matrix liquid crystal display device according to the present embodiment can be used as any of the active matrix liquid crystal display devices of Embodiments 1 to 8.

Reference will be made to FIGS. 26(A) to (E). First, a silicon oxide film 5002 of thickness 200 nm was formed on a glass substrate 5001 as a base film. The base film may also include a silicon nitride film stacked on the silicon oxide film 5002, or may be formed of a silicon nitride film alone.

Then, a 30-nm-thick amorphous silicon film was formed on the silicon oxide film 5002 by a plasma CVD method, and after dehydrogenation, excimer laser annealing was executed to form a polysilicon film (a crystalline silicon film or a polycrystalline silicon film).

This crystallization step may use a known laser crystallization technique or thermal crystallization technique. In the present embodiment, a pulse oscillation type of KrF excimer laser was condensed into a linear shape to crystallize the amorphous silicon film.

Incidentally, in the present embodiment, the amorphous silicon film was formed as an initial film and was crystallized by laser annealing, thereby forming the polysilicon film. However, a microcrystalline silicon film may also be used as an initial film or the polysilicon film may also be directly formed. Of course, laser annealing may be applied to the formed polysilicon film. Furnace annealing may also be executed instead of laser annealing.

The thus-formed crystalline silicon film was patterned to form active layers 5003 and 5004 made from island-shaped silicon layers.

Figure 26A:
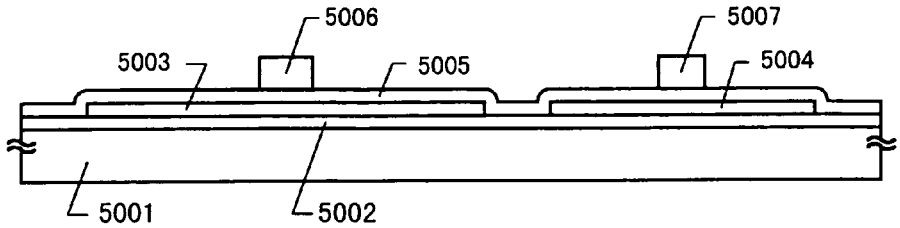
FIGS. 26(A) to 26(E) are views showing an example of the process of fabricating an active matrix liquid crystal display device according to Embodiment 9.
Figure 26B:
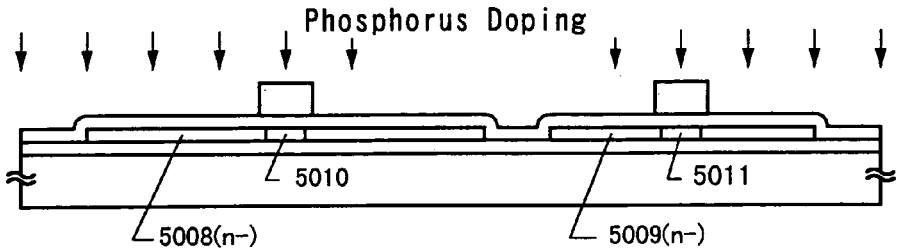

Then, a gate insulating film 5005 made of a silicon oxide film was formed to cover the active layers 5003 and 5004, and gate lines (including gate electrodes) 5006 and 5007 each made of a stacked structure of tantalum and tantalum nitride were formed on the gate insulating film 5005 (FIG. 26(A)).

The gate insulating film 5005 had a thickness of 100 nm. Instead of the silicon oxide film, it is possible to use a stacked structure of a silicon oxide film and a silicon nitride film or silicon oxide nitride film. Although another metal can be used for the gate lines 5006 and 5007, it is desirable to use a material having a high etching selection ratio with respect to silicon in a later step.

After the state shown in FIG. 26(A) had been obtained in this manner, a first phosphorus-doping step (phosphorus-adding step) was performed. In this step, the acceleration voltage was set to a high voltage of 80 keV to add phosphorus through the gate insulating film 5005. The dose of phosphorus was adjusted so that each of the thus-formed first impurity regions 5008 and 5009 was made 0.5 μm in length (width) and $1\times10^{17}$ atoms/cm$^3$ in the concentration of phosphorus. The concentration of phosphorus at this time is represented by (n−). Incidentally, it is preferable to substitute arsenic for phosphorus.

The first impurity regions 5008 and 5009 were formed in a self-aligned manner by using the gate lines 5006 and 5007 as masks. At this time, intrinsic crystalline silicon layers were left directly below the gate lines 5006 and 5007, and channel formation regions 5010 and 5011 were formed. Actually, since a small amount of phosphorus was added to regions below the gate lines 5006 and 5007, a structure in which the respective gate lines 5006 and 5007 overlap the first impurity regions 5008 and 5009 is formed (FIG. 26(B)).

Then, sidewalls 5012 and 5013 were formed by forming an amorphous silicon layer of thickness 0.1–1 μm (representatively, 0.2–0.3 μm) to cover the gate lines 5006 and 5007 and performing anisotropic etching of the amorphous silicon layer. Each of the widths of the respective sidewalls 5012 and 5013 (each of the thicknesses of the same as viewed from the side walls of the gate lines 5006 and 5007) was made 0.2 μm (FIG. 26(C)).

It is to be noted that, in the present embodiment, the sidewalls 5012 and 5013 were formed of an intrinsic silicon layer because no impurities were added to the amorphous silicon layer.

Figure 26C:
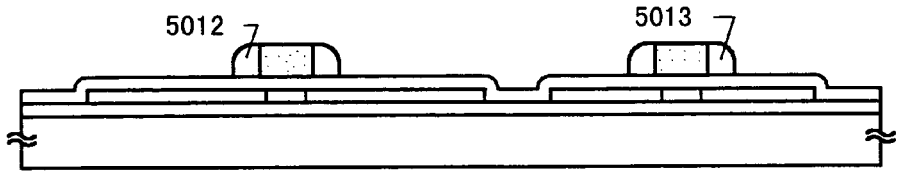

After the state shown in FIG. 26(C) had been obtained, a second phosphorus-doping step was performed. In this case as well, the acceleration voltage was set to 80 keV, as in the first phosphorus-doping step. The dose of phosphorus was adjusted so that phosphorus was contained in each of the thus-formed second impurity regions 5014 and 5015 at a concentration of $1\times10^{18}$ atoms/cm$^3$. The concentration of phosphorus at this time is represented by (n).

Incidentally, in the phosphorus-doping step shown in FIG. 26(D), the first impurity regions 5008 and 5009 are left directly below only the sidewalls 5012 and 5013, respectively. These first impurity regions 5008 and 5009 function as 1st LDD regions.

Figure 26D:
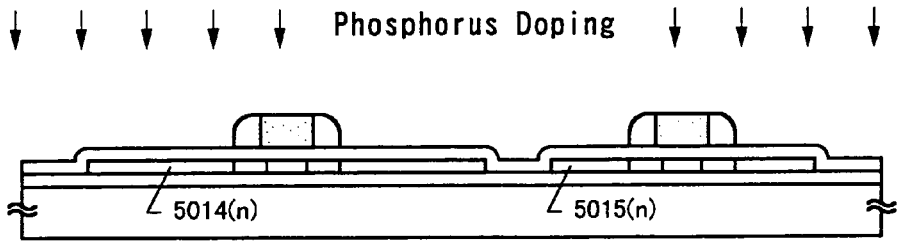

In addition, in the step shown in FIG. 26(D), phosphorus was added to the sidewalls 5012 and 5013. Actually, since the acceleration voltage is high, phosphorus was distributed in the state in which the tail of the concentration profile of phosphorus reached the inside of each of the sidewalls 5012 and 5013. The resistance components of the sidewalls 5012 and 5013 can be adjusted by this phosphorus, but if the concentration distribution of phosphorus is extremely non-uniform, a gate voltage to be applied to the second impurity region 5014 is liable to vary from element to element. Accordingly, precise control is needed during doping.

Then, a resist mask 5016 which covers part of an NTFT and a resist mask 5017 which covers the whole of a PTFT were formed. Then, in this state, a gate insulating film 5018 was formed by working the gate insulating film 5005 by dry etching (FIG. 26(E)).

At this time, the length of the portion of the gate insulating film 5018 which projected from the sidewall 5012 (the length of the portion of the gate insulating film 5018 which was in contact with the second impurity region 5014) determined the length (width) of the second impurity region 5014. Accordingly, the resist mask 5016 needed to be aligned with high accuracy.

Figure 26E:
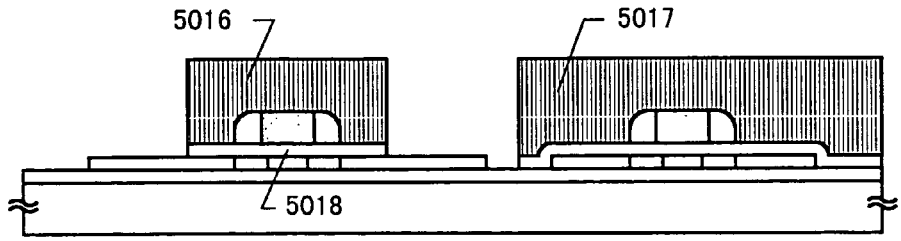
Figure 27A:
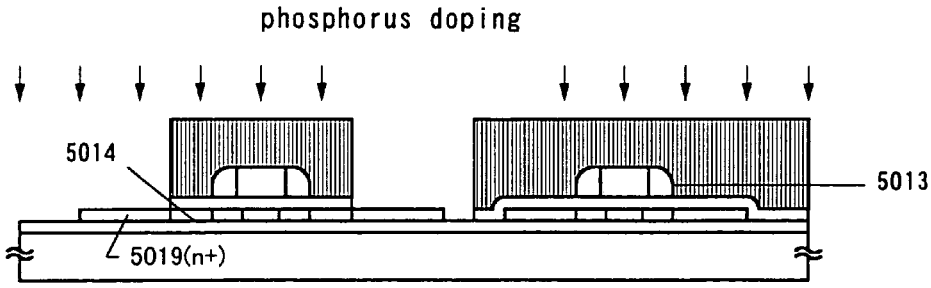
FIGS. 27(A) to 27(D) are views showing the example of the process of fabricating the active matrix liquid crystal display device according to Embodiment 9.

After the state shown in FIG. 26(E) had been obtained, a third phosphorus-doping step was performed. In this step, since phosphorus was added to the exposed active layers, the acceleration voltage was set to a low voltage of 10 keV. Incidentally, the dose of phosphorus was adjusted so that phosphorus was contained in the thus-formed third impurity region 5019 at a concentration of $5\times10^{20}$ atoms/cm$^3$. The concentration of phosphorus at this time is represented by (n+) (FIG. 27(A)).

In this step, since no phosphorus was added to the portions shielded by the resist masks 5016 and 5017, the second impurity regions 5014 and 5015 were left without modification in the portions. Accordingly, the second impurity region 5014 was defined, and at the same time the third impurity region 5019 was defined.

The second impurity region 5014 functions as a 2nd LDD region, and the third impurity region 5019 functions as a source region or a drain region.

Then, the resist masks 5016 and 5017 were removed, and a resist mask 5021 was newly formed to cover the whole of the NTFT. Then, the sidewall 5013 of the PTFT was removed, and the gate insulating film 5005 was dry-etched to form a gate insulating film 5022 of the same shape as the gate line 5007 (FIG. 27(B)).

Figure 27B:
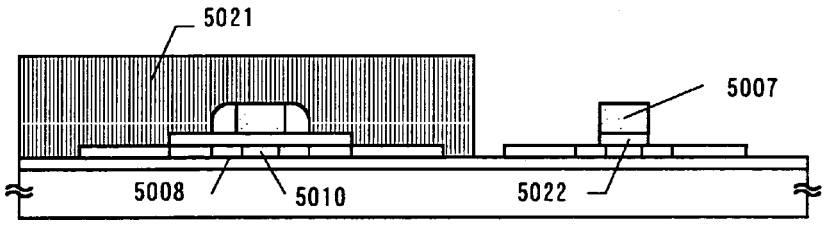

After the state shown in FIG. 27(B) had been obtained, a boron-doping step (a boron-adding step) was performed. In this step, the acceleration voltage was set to 10 keV, and the dose of boron was adjusted so that boron was contained in a formed fourth impurity region 5023 at a concentration of $3\times10^{20}$ atoms/cm$^3$. The concentration of boron at this time is represented by (p++) (FIG. 27(C)).

At this time, since boron was added to a region below the gate line 5007, the channel formation region 5011 was formed within the region below the gate line 5007. In addition, in this step, the first impurity region 5009 and the second impurity region 5015 formed on the PTFT side were inverted to P-type regions by boron. Accordingly, a resistance value changes between a portion which was originally the first impurity region 5009 and a portion which was the second impurity region 5015, but no problem occurs because boron is added at a fully high concentration.

In this manner, a fourth impurity region 5023 was defined. The fourth impurity region 5023 is formed in a completely self-aligned manner by using the gate line 5007 as a mask, and functions as a source region or a drain region. In the present embodiment, although neither an LDD region nor an offset region is formed for the PTFT, no problem occurs because the PTFT is originally high in reliability. Contrarily, this is also a case in which it is convenient to dispose neither an LDD region nor the like, because ON current can be ensured.

Figure 27C:
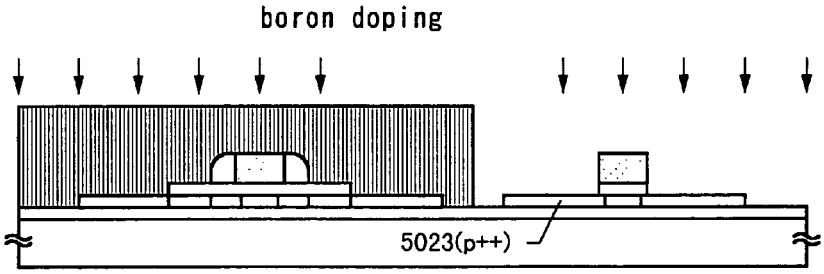

In this manner, as shown in FIG. 27(C), finally, the channel formation region 5010, the first impurity region 5008, the second impurity region 5014 and the third impurity region 5019 are formed in the active layer of the NTFT, whereas the channel formation region 5011 and the fourth impurity region 5023 are formed in the active layer of the PTFT.

After the state shown in FIG. 27(C) had been obtained in the above-described manner, a first interlayer insulating film 5024 of thickness 1 μm was formed. As the first interlayer insulating film 5024, it is possible to use a silicon oxide film, a silicon nitride film, a silicon oxide nitride film or an organic resin film or a stacked film of arbitrary ones of these films. In the present embodiment, an acrylic resin film was adopted.

After the first interlayer insulating film 5024 had been formed, source lines 5025 and 5026 and a drain line 5027 made of a metallic material were formed. In the present embodiment, a three-layer line was used which had a structure in which a titanium-containing aluminum film was sandwiched between titanium layers.

If a resin film called BCB (benzodiclobutene) is used as the first interlayer insulating film 5024, the flatness of the first interlayer insulating film 5024 is improved and copper can be used as a line material. Since copper has a low line resistance, it is very useful as a line material.

After the source lines 5025 and 5026 and the drain line 5027 had been formed, a silicon nitride film 5028 of thickness 50 nm was formed as a passivation film. Furthermore, a second interlayer insulating film 5029 was formed over the silicon nitride film 5028 as a protection film. A material similar to that of the first interlayer insulating film 5024 can be used for the second interlayer insulating film 5029. In the present embodiment, a structure in which an acrylic resin film was stacked on a 50-nm-thick silicon oxide film was adopted.

Figure 27D:
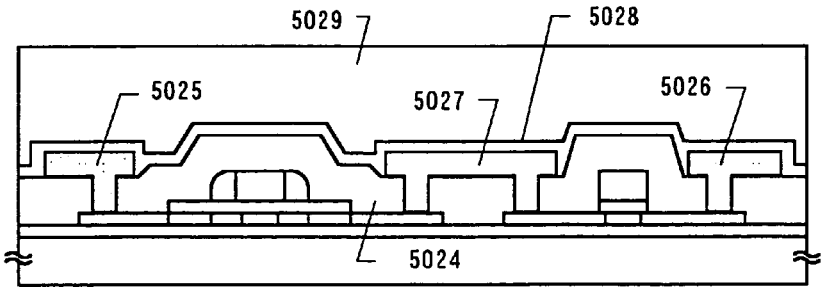

Through the above-described steps, a CMOS circuit having the structure shown in FIG. 27(D) was finished. In the CMOS circuit finished in the present embodiment, because the NTFT had superior reliability, the reliability of the entire circuit was improved to a great extent. In addition, in the structure of the present embodiment, the balance in characteristic (electrical characteristic) between the NTFT and the PTFT was superior.

Similarly, pixel TFTs can be formed by NTFTs.

After the state shown in FIG. 27(D) had been obtained, contact holes are opened and pixel electrodes which are connected to the drain electrodes of the pixel TFTs are formed. Then, a third interlayer film is formed and an alignment film is formed. In addition, a black matrix may be formed as required.

Then, a counter substrate is prepared. The counter substrate is made of a glass substrate, a counter electrode made of a transparent conductive film and an alignment film.

In the present embodiment, a polyimide film was used as the alignment film. After the formation of the alignment film, rubbing was applied to the alignment film. In the present embodiment, polyimide having a comparatively large pretilt angle was used for the alignment film.

Then, the active matrix substrate and the counter substrate which had passed through the above-described steps were bonded together via a sealing member or a spacer in a known cell assembly step. After that, a liquid crystal is charged between both substrates and completely sealed by a sealant. In the present embodiment, the liquid crystal used was a nematic liquid crystal.

Thus, a transmission type of active matrix liquid crystal display device was finished.

Embodiment 10

In the description of the present embodiment, reference will be made to an example in which a crystalline semiconductor film which constitutes active layers in Embodiment 9 is formed by a thermal crystallization method using a catalytic element. If a catalytic element is to be used, it is preferable to use the arts described in Japanese Patent Laid-Open Nos. 130652/1995 and 78329/1996 filed by the present inventor.

Figure 28A:
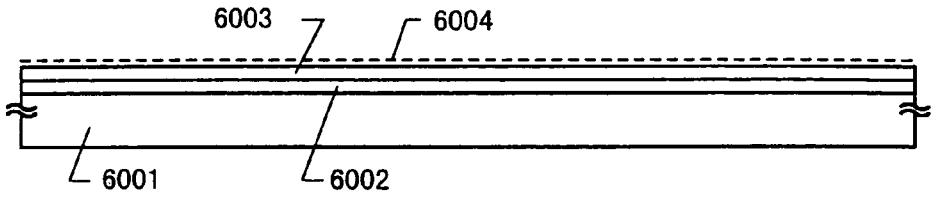
FIGS. 28(A) and 28(B) are views showing the example of the process of fabricating an active matrix liquid crystal display device according to Embodiment 10.
Figure 28B:
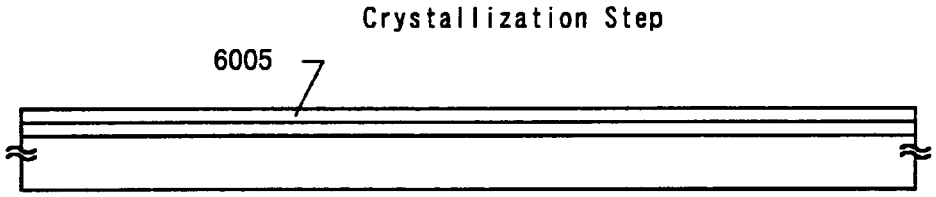

FIG. 28 shows an example in which the art Japanese Patent Laid-Open Nos. 130652/1995 is applied to the present invention. First, a silicon oxide film 6002 was formed on a silicon substrate 6001 by a thermal oxidation method, and an amorphous silicon film 6003 was formed on the silicon oxide film 6002. Furthermore, a nickel-containing layer 6004 was formed by coating the amorphous silicon film 6003 with a nickel acetate solution which contained nickel of 10 ppm by weight (FIG. 28(A)).

Then, after a dehydrogenation step of 500° C. for 1 hour, heat treatment of 4–12 hours at 500–650° C. (in the present embodiment, 8 hours at 550° C.) was performed to form a polysilicon film 6005. The thus-formed polysilicon film 6005 had highly excellent crystallinity (FIG. 28(B)).

Subsequently, the polysilicon film 6005 was formed into active layers by patterning, and TFTs were fabricated through steps similar to those used in Embodiment 9.

Incidentally, in each of the above-described two arts, it is also possible to use elements other than nickel (Ni), such as germanium (Ge), iron (Fe), palladium (Pd), tin (Sn), lead (Pb), cobalt (Co), platinum (Pt), copper (Cu) and gold (Au).

Embodiment 11

In the description of the present embodiment, reference will be made to one example a method of fabricating an active matrix liquid crystal display device different from that described previously in connection with Embodiment 1 or 9. The active matrix liquid crystal display device of the present embodiment can be used as an active matrix liquid crystal display device in any of Embodiments 1 to 8.

Reference will be made to FIGS. 29(A) to 29(E) and FIGS. 30(A) and 30(B). A substrate 7001 used a non-alkali glass substrate which was represented by, for example, the 1737 glass substrate of Corning Incorporated. A 200-nm-thick base film 7002 made of silicon oxide was formed on the surface of the substrate 7001 over which TFTs are to be formed. The base film 7002 may also include a silicon nitride film stacked on the silicon oxide film, or may be formed of a silicon nitride film alone.

Then, a 50-nm-thick amorphous silicon film was formed on the base film 7002 by a plasma CVD method. Dehydrogenation treatment was performed by heating at, preferably, 400–500° C. which depended on the hydrogen content of the amorphous silicon film, thereby reducing the hydrogen content of the amorphous silicon film to 5 atm % or below. Then, a crystallization step was performed to form the amorphous silicon film into a crystalline silicon film.

This crystallization step may use a known laser crystallization technique or thermal crystallization technique. In the present embodiment, a pulse oscillation type of KrF excimer laser was condensed into a linear shape to illuminate the amorphous silicon film, thereby forming the crystalline silicon film. Incidentally, this crystallization may also use the method described previously in connection with Embodiment 1 or 10.

Incidentally, in the present embodiment, the amorphous silicon film was used as an initial film, but a microcrystalline silicon film may also be used as an initial film or the crystalline silicon film may also be directly formed.

The thus-formed crystalline silicon film was patterned to form island-shaped semiconductor layers 7003, 7004 and 7005.

Then, a gate insulating film 7006 which essentially consisted of silicon oxide or silicon nitride was formed to cover the semiconductor layers 7003, 7004 and 7005. In this step, a silicon oxide nitride film was formed to a thickness of 100 nm by a plasma CVD method. Then, although not illustrated in FIGS. 29(A) to 29(E), a tantalum (Ta) film of thickness 10–200 nm, for example, 50 nm, and an aluminum (Al) film of thickness 100–1000 nm, for example, 200 nm, were respectively formed by a sputtering method as first conductive films and second conductive films which constituted first gate electrodes on the surface of the gate insulating film 7006. Then, first conductive films 7007, 7008, 7009 and 7010 and second conductive films 7012, 7013, 7014 and 7015 were formed to constitute the first gate electrodes, by a known patterning technique.

If aluminum is to be used for the second conductive films 7012, 7013, 7014 and 7015 which constitute the first gate electrodes, pure aluminum may also be used, or an aluminum alloy which contains by 0.1–5 atm % an element selected from among titanium, silicon and scandium may also be used. If copper is to be used, it is preferable that, although not shown, a silicon nitride film be formed on the surface of the gate insulating film 7006.

Figures 29A, 29B, 29C, 29D, 29E:
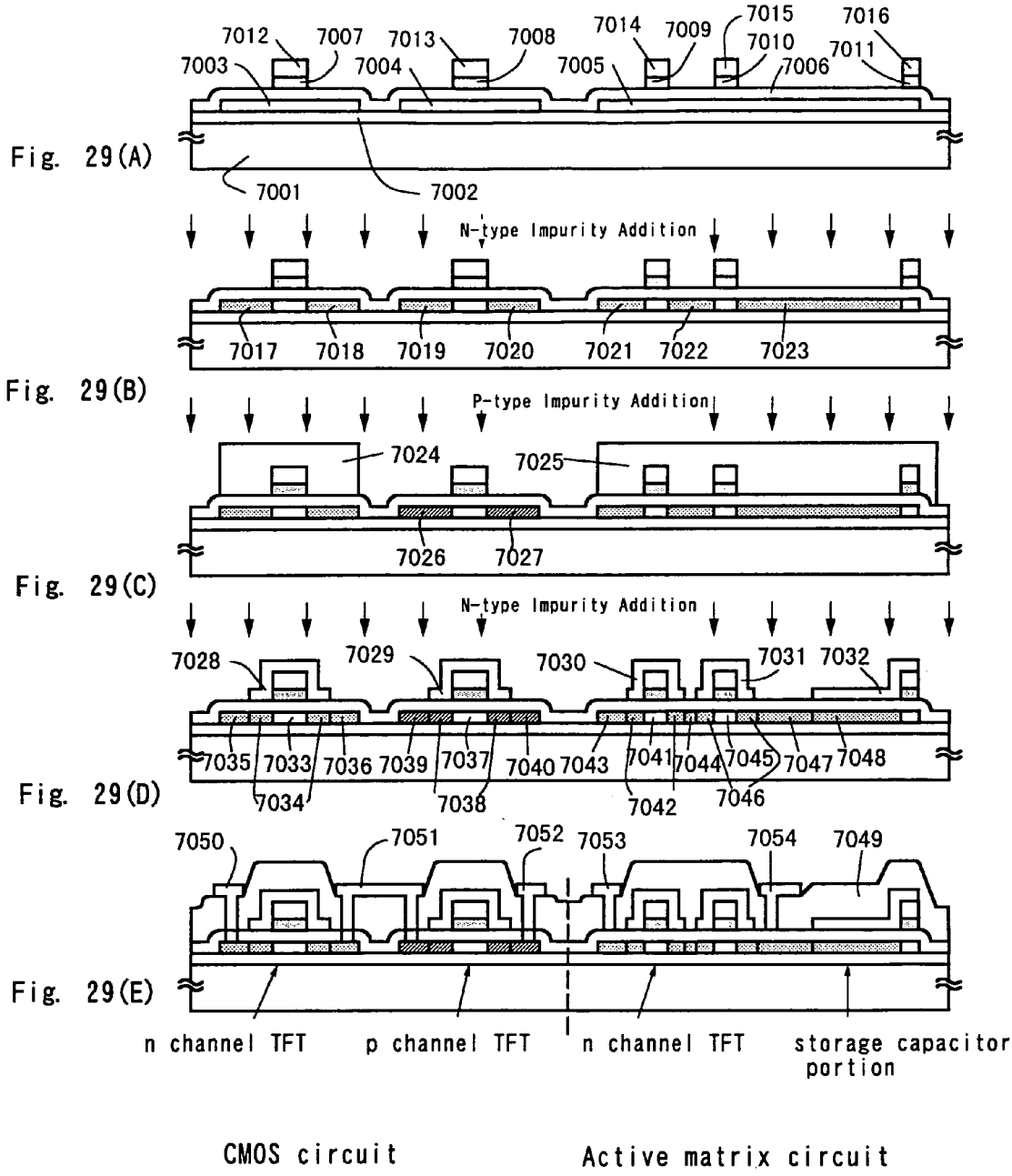
FIGS. 29(A) to 29(E) are views showing an example of the process of fabricating an active matrix liquid crystal display device according to Embodiment 11.

In FIG. 29(A), there is shown a structure in which an additional capacitor portion is provided on the drain side of an n-channel TFT which constitutes a pixel matrix circuit. In this step, line electrodes 7011 and 7016 of the additional capacitor portion are formed by using a material identical to that of the first gate electrodes.

After the structure shown in FIG. 29(A) had been formed in the above-described manner, a first step of adding an n-type impurity was performed. Phosphorus (P), arsenic (As), antimony (Sb) and the like are known as impurity elements which impart the n-type to crystalline semiconductor materials, and in the first step, phosphorus was added by an ion-doping method using phosphine (PH3). In the first step, the acceleration voltage was set to a high voltage of 80 keV to add phosphorus to the underlying semiconductor layers 7003, 7004 and 7005 through the gate insulating film 7006. The thus-formed impurity regions form first impurity regions 7034, 7042 and 7046 of n-channel TFTs which will be described later and function as LDD regions. Therefore, it is preferable to adjust the concentration of phosphorus in each of these impurity regions within the range of $1\times10^{16}$ to $1\times10^{19}$ atoms/cm$^3$. In this step, the concentration of phosphorus was adjusted to $1\times10^{18}$ atoms/cm$^3$.

The impurity element added to the semiconductor layers 7003, 7004 and 7005 needed to be activated by a laser annealing method or a heat treatment. This step may be carried out after the step of adding an impurity to form source and drain regions, but it was effective to activate the impurity element by a laser annealing method in this stage.

In this step, the first conductive films 7007, 7008, 7009 and 7010 and the second conductive films 7012, 7013, 7014 and 7015 which constituted the first gate electrodes function as masks during the addition of phosphorus. Consequently, phosphorus was not at all or hardly added to the regions of the semiconductor layers 7003, 7004 and 7005 which underlay the gate insulating film 7006, directly below the first gate electrodes. Then, as shown in FIG. 29(B), phosphorus-added low-concentration impurity regions 7017, 7018, 7019, 7020, 7021, 7022 and 7023 were formed.

Then, regions in which to form the n-channel TFTs were covered with resist masks 7024 and 7025 by using a photoresist film as mask, and only a region in which to form a p-channel TFT was subjected to the step of adding an impurity to impart the p-type. Boron (B), aluminum (Al) and gallium (Ga) are known as impurity elements which impart the p-type, and in this step, boron was added as such impurity element by an ion-doping method using diborane (B2H6). In this step as well, the acceleration voltage was set to 80 keV to add boron at a concentration of $2\times10^{20}$ atoms/cm$^3$. Thus, as shown in FIG. 29(C), regions 7026 and 7027 to which boron was added at a high concentration were formed. Each of the regions 7026 and 7027 becomes a source or drain region of the p-channel TFT at a later step.

Then, after the resist masks 7024 and 7025 had been removed, the step of forming second gate electrodes was performed. In this step, tantalum (Ta) was used as the material of the second gate electrodes, and a tantalum film of thickness 100–1000 nm, for example, 200 nm, was formed. Then, patterning using a known technique was performed to form second gate electrodes 7028, 7029, 7030 and 7031. At this time, patterning was performed so that the length of each of the second gate electrodes 7028, 7029, 7030 and 7031 became 5 μm. Consequently, each of the second gate electrodes 7028, 7029, 7030 and 7031 was formed to have areas each of which was 1.5 μm long and which were in contact with the gate insulating film 7006 on the opposite sides of the corresponding one of the first gate electrodes.

Although a holding capacitor portion was disposed on the drain side of the n-channel TFT which constituted the pixel matrix circuit, an electrode 7032 for the holding capacitor portion was formed at the same time as the second gate electrodes 7028, 7029, 7030 and 7031.

Then, a second step of adding an impurity element to impart the n-type was performed by using the second gate electrodes 7028, 7029, 7030 and 7031 as masks. This step was also performed by an ion-doping method using phosphine (PH3). In this step as well, the acceleration voltage was set to a high voltage of 80 keV to add phosphorus to the underlying semiconductor layers through the gate insulating film 7006. In this step, it is preferable to adjust the concentration of phosphorus within the range of $1\times10^{19}$ to $1\times10^{21}$ atoms/cm$^3$ in each region in which to add phosphorus so that the regions can be made to function as source regions 7035 and 7043 and drain regions 7036 and 7047 of the n-channel TFTs. In the present embodiment, the concentration of phosphorus was set to $1\times10^{20}$ atoms/cm$^3$.

Although not shown in FIGS. 29(A) to 29(E), the portions of the gate insulating film 7006 which cover the source regions 7035 and 7043 and the drain regions 7036 and 7047 may be removed so that the portions of the semiconductor layers which respectively correspond to the source regions 7035 and 7043 and the drain regions 7036 and 7047 are exposed and phosphorus is directly added. When this step was added, the acceleration voltage in the ion-doping method was able to be lowered to 10 keV and phosphorus was able to be effectively added.

In addition, phosphorus was added to a source region 7039 and a drain region 7040 of the p-channel TFT at the same concentration, but because boron was added at a concentration twice as high as the concentration of phosphorus in the previous step, the conductivity type of the p-channel TFT was not inverted and the p-channel TFT was able to operate without any problem.

Since the impurity elements which were added at the respective concentrations to impart the n- and p-types were not immediately activated and did not work effectively, it was necessary to perform an activation step. This step was able to be performed with a thermal annealing method using an electrical heating reactor, a laser annealing method using the above-described excimer laser or a rapid thermal annealing (RTA) method using a halogen lamp.

In the thermal annealing method, activation was effected by executing a heat treatment of 550° C. for 2 hours in a nitrogen atmosphere. In the present embodiment, aluminum was used for the second conductive films 7012, 7013, 7014 and 7015 which constituted the first gate electrodes, but the first conductive films 7007, 7008, 7009 and 7010 as well as the second gate electrodes 7028, 7029, 7030 and 7031 all of which were formed of tantalum were formed to cover aluminum, and tantalum functioned as a blocking layer so that aluminum atoms could be prevented from diffusing in another region. In the laser annealing method, a pulse oscillation type of KrF excimer laser was condensed into a linear shape to illuminate the regions in which the impurity elements were added, thereby causing activation thereof. In addition, if the thermal annealing method was carried out after the laser annealing method had been carried out, a far better result was able to be obtained. The activation step also had the effect of annealing a region having crystallinity destroyed by ion-doping, and was able to improve the crystallinity of the region.

Through the above-described steps, the first gate electrodes and the second gate electrodes which respectively covered the first gate electrodes were disposed, and in each of the n-channel TFTs, the source region and the drain region were formed on the opposite sides of the corresponding second gate electrode. In addition, the structure in which the first impurity regions formed in the semiconductor layers underlying the gate insulating film and the regions in which the second gate electrodes were in contact with the gate insulating film were disposed in a superimposed manner was formed in a self-aligned manner. In the p-channel TFT, the source region and the drain region were formed to partly overlap the corresponding second gate electrodes, but no problem occurred in practical use. In FIG. 29(D), reference numerals 7033, 7037, 7041, 7045 denote channel formation regions.

After the state shown in FIG. 29(D) had been obtained, a first interlayer insulating film 7049 of thickness 1000 nm was formed. As the first interlayer insulating film 7049, it is possible to use a silicon oxide film, a silicon nitride film, a silicon oxide nitride film or an organic resin film or a stacked film of arbitrary ones of these films. In the present embodiment, although not shown, a two-layer structure was prepared by forming a silicon nitride film of thickness 50 nm, and further forming a silicon oxide film of thickness 950 nm.

After that, contact holes were formed in the source regions and the drain regions of the respective TFTs by patterning the first interlayer insulating film 7049. Thus, source electrodes 7050, 7052 and 7053 and drain electrodes 7051 and 7054 were formed. Although not shown, in the present embodiment, these source and drain electrodes were formed by patterning a film having a three-layer structure in which a titanium film of thickness 100 nm, a titanium-containing aluminum film of thickness 300 nm and a titanium film of thickness 150 nm were continuously formed by a sputtering method.

Thus, a CMOS circuit and an active matrix circuit were formed over the substrate 7001, as shown in FIG. 29(E). In addition, the additional capacitor portion was simultaneously formed on the drain side of the n-channel TFT of the active matrix circuit. In the above-described manner, an active matrix substrate was formed.

Then, the step of fabricating an active matrix liquid crystal display device on the basis of the CMOS circuit and the active matrix circuit which were fabricated over one substrate by the above-described steps will be described with reference to FIGS. 30(A) and 30(B). First of all, a passivation film 7055 which covered the source electrodes 7050, 7052 and 7053, the drain electrodes 7051 and 7054 and the first interlayer insulating film 7049 was formed over the substrate in the state shown in FIG. 29(E). The passivation film 7055 was formed of a silicon nitride film of thickness 50 nm. A second interlayer insulating film 7056 made of an organic resin was formed to a thickness of about 1000 nm over the passivation film 7055. Polyimide, acrylic, polyimide amide and the like can be used as the organic resin film. The organic resin film has a number of advantages such as the advantages that its film formation method is simple; its film thickness can readily be increased; its parasitic capacitor can be reduced because of its low dielectric constant; and its flatness is superior. Incidentally, an organic resin film other than the above-described ones can also be used. In this step, polyimide of the type which was to be thermally polymerized after being applied to the substrate was used, and the second interlayer insulating film 7056 was formed by burning at 300° C.

Then, a light blocking layer 7057 was formed on part of a pixel area of the second interlayer insulating film 7056. The light blocking layer 7057 may be formed of a metallic film or an organic resin film which contains a pigment. In this step, titanium was formed by a sputtering method.

After the light blocking layer 7057 had been formed, a third interlayer insulating film 7058 was formed. This third interlayer insulating film 7058 may be formed of an organic resin film similarly to the second interlayer insulating film 7056. Then, a contact hole which reached the drain electrode 7054 was formed in the second interlayer insulating film 7056 and the third interlayer insulating film 7058, thereby forming a pixel electrode 7059. The pixel electrode 7059 may use a transparent conductive film in the case of a transmission type of liquid crystal display device, or a metallic film in the case of a reflection type of liquid crystal display device. In this step, to obtain a transmission type of liquid crystal display device, an indium tin oxide (ITO) film of thickness 100 nm was formed by a sputtering method, and the pixel electrode 7059 was formed.

Figure 30A:
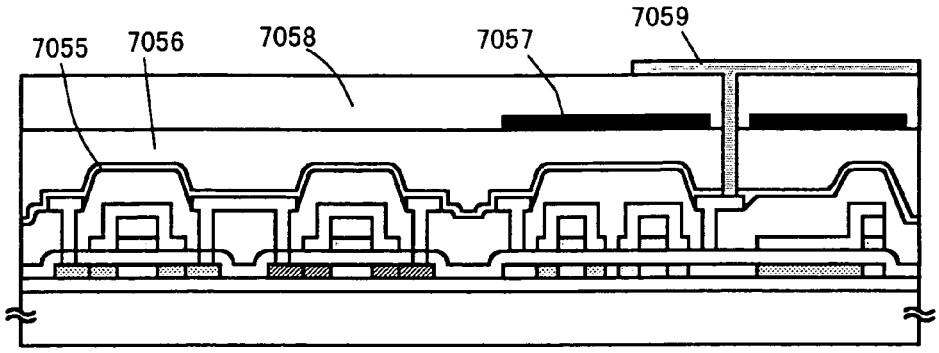
FIGS. 30(A) and 30(B) are views showing the example of the process of fabricating the active matrix liquid crystal display device according to Embodiment 11.
Figure 30B:
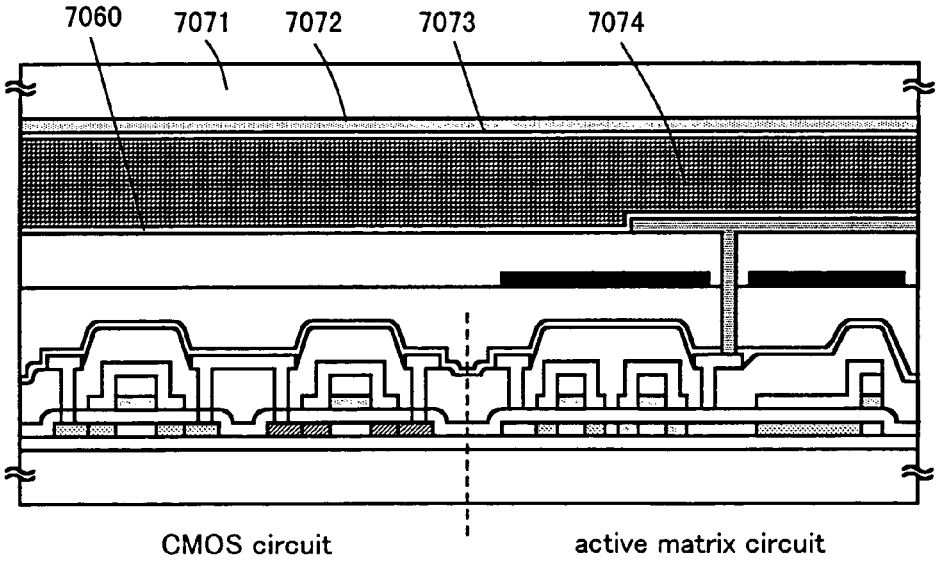

After the state shown in FIG. 30(A) had been obtained, an alignment film 7060 was formed. In many liquid crystal display devices, polyimide resins are normally used for alignment films. A counter electrode 7072 and an alignment film 7073 were formed over a counter substrate 7071. After the alignment film 7073 had been formed, rubbing treatment was applied to the alignment film 7073 so that its liquid crystal molecules were aligned in parallel with one another at a certain constant pretilt angle.

The substrate on which the active matrix circuit and the CMOS circuit had been formed through the above-described steps and the counter substrate are bonded together via a sealing member or a spacer (neither of which is shown) in a known cell assembly step. After that, a liquid crystal 7074 is charged between both substrates and completely sealed by a sealant (not shown). Thus, the active matrix liquid crystal display device shown in FIG. 30(B) was finished.

According to the driving method of the present invention, by supplying a modulated clock signal frequency modulated at a constant period to a driving circuit of an active matrix semiconductor display device or a passive matrix semiconductor display device, signal information (the presence or absence of an edge, the extent of nearness) relative to the vicinity of the sampling of video signals sampled on the basis of this modulated clock signal can be written to the corresponding pixels of the semiconductor display device as shading information. According to the driving method of the present invention, the resolution of a displayed image is apparently improved as the result of a visual Mach phenomenon and Craik-O'Brien phenomenon. Accordingly, it is possible to provide a good image having a substantially higher resolution than that obtainable in either of an active matrix semiconductor display device and a passive matrix semiconductor display device according to the conventional driving method.

In addition, according to the driving method of the present invention, it is possible to adequately display an image signal which conforms to a low-resolution standard signal, on an active matrix liquid crystal display device which conforms to a high-resolution standard.

What is claimed is:

1. A method of driving a display device, comprising the steps of:

performing sampling and A/D conversion on an analog image signal on the basis of a reference clock signal and obtaining a digital image signal;

after performing digital signal processing on the digital image signal, performing D/A conversion on the digital image signal on the basis of a modulated clock signal and obtaining an improved analog image signal; and supplying the improved analog image signal to a source signal line, wherein at least two gate signal lines are selected at a same time when the improved analog image signal is inputted to the source signal line.

2. A method of driving a display device, comprising the steps of:

frequency modulating a reference clock signal and obtaining a modulated clock signal;

performing sampling and A/D conversion on an analog image signal on the basis of the modulated clock signal and obtaining a digital image signal;

after performing digital signal processing on the digital image signal, performing D/A conversion on the digital image signal on the basis of the reference clock signal and obtaining an improved analog image signal; and supplying the improved analog image signal to a corresponding pixel and obtaining an image.

3. A method of driving a display device, comprising the steps of:

performing sampling and A/D conversion on an analog image signal on the basis of a reference clock signal and obtaining a digital image signal;

after performing digital signal processing on the digital image signal, performing D/A conversion on the digital image signal on the basis of a modulated clock signal and obtaining an improved analog image signal; and supplying the improved analog image signal to a corresponding pixel and obtaining an image, wherein the modulated clock signal is obtained by shifting a frequency of the reference clock signal on the basis of a Gaussian histogram.

4. A method of driving a display device according to claim 1 wherein said display device is an active matrix type display device.

5. A method of driving a display device according to claim 1 wherein said display device is a passive matrix type display device.

6. A method according to claim 1 wherein said display device is a liquid crystal display device.

7. A method according to claim 1 wherein said display device is an electroluminescence display device.

8. A method of driving a display device according to claims 2 or 3 wherein said display device is an active matrix type display device.

9. A method of driving a display device according to claims 2 or 3 wherein said display device is a passive matrix type display device.

10. A method according to claims 2 or 3 wherein said display device is a liquid crystal display device.

11. A method according to claims 2 or 3 wherein said display device is an electroluminescence display device.

12. A method of driving a display device according to claim 2, wherein the modulated clock signal is obtained by shifting a frequency of the reference clock signal on the basis of a Gaussian histogram.

13. A display device comprising:

an active matrix circuit having a plurality of thin-film transistors arranged in a matrix form; and a source signal line-side driving circuit to which a digital image signal is inputted, and a gate signal line-side driving circuit for driving said active matrix circuit, wherein a first modulated clock signal obtained by frequency modulating a reference clock signal is inputted to said source signal line-side driving circuit, while a second modulated clock signal which differs from said first modulated clock signal in quantity of frequency shifting or method of frequency modulation is inputted to said gate signal line-side driving circuit, and wherein said digital image signal is converted to an analog image signal by D/A conversion on the basis of said first modulated clock signal.

14. A display device according to claim 13 wherein said display device is a liquid crystal display device.

15. A display device according to claim 13 wherein said display device is an electroluminescence display device.

16. A display device according to claim 13, wherein the first modulated clock signal and the second modulated clock signal are obtained by shifting a frequency of the reference clock signal on the basis of a Gaussian histogram.

17. A digital camera having a display device according to claim 13.

18. A player which uses a recording medium, having a display device according to claim 13.

19. A personal computer having a display device according to claim 13.

20. A head-mounted display having a display device according to claim 13.

21. A mobile computer having a display device according to claim 13.

22. A mobile telephone having a display device according to claim 13.

23. A projector having a display device according to claim 13.

24. A video camera having a display device according to claim 13.

* * * * *

UNITED STATES PATENT AND TRADEMARK OFFICE

CERTIFICATE OF CORRECTION

PATENT NO. : 7,190,360 B1
APPLICATION NO. : 09/382677
DATED : March 13, 2007
INVENTOR(S) : Masaaki Hiroki It is certified that error appears in the above-identified patent and that said Letters Patent is hereby corrected as shown below:

Column 3, between lines 5 and 6, insert --frequency modulating a reference clock signal and obtaining a modulated clock signal;--.

Column 3, line 7, replace “a reference clock signal” with --the modulated clock signal--.

Column 3, delete lines 18-19.

Column 3, line 21, replace “the modulated clock signal” with --a reference clock signal--.

Signed and Sealed this

Twentieth Day of November, 2007

JON W. DUDAS
*Director of the United States Patent and Trademark Office*